US007403170B2

(12) United States Patent
Kanno et al.

(10) Patent No.: US 7,403,170 B2
(45) Date of Patent: Jul. 22, 2008

(54) DIFFERENTIAL-FEED SLOT ANTENNA

(75) Inventors: Hiroshi Kanno, Osaka (JP); Ushio Sangawa, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/905,001

(22) Filed: Sep. 27, 2007

(65) Prior Publication Data

US 2008/0024378 A1 Jan. 31, 2008

Related U.S. Application Data

(63) Continuation-in-part of application No. PCT/JP2007/056215, filed on Mar. 26, 2007.

(30) Foreign Application Priority Data

Apr. 3, 2006 (JP) ..... 2006-101741

(51) Int. Cl.
*H01Q 13/10* (2006.01)

(52) U.S. Cl. ..... 343/770; 343/767; 343/768; 343/846; 343/876

(58) Field of Classification Search ..... 343/770
See application file for complete search history.

(56) References Cited

U.S. PATENT DOCUMENTS 5,977,916 A 11/1999 Vannatta et al.
6,031,503 A * 2/2000 Preiss et al. ..... 343/770
6,765,450 B2 7/2004 Howard et al.
2003/0020664 A1 1/2003 Thudor et al.
2004/0066345 A1 4/2004 Schadler
2005/0237252 A1 10/2005 Thudor et al.
2005/0285809 A1 12/2005 Louzir et al.
2006/0066495 A1 * 3/2006 Isoifovich et al. ..... 343/770
2007/0171140 A1 * 7/2007 Minard et al. ..... 343/770

FOREIGN PATENT DOCUMENTS

JP 10-335931 12/1998
JP 11-23692 1/1999
JP 2003-101337 4/2003
JP 2003-273632 9/2003
JP 2004-274757 9/2004
JP 2005-27317 1/2005
JP 2006-42042 2/2006

OTHER PUBLICATIONS

International Search Report issued in corresponding International Patent Application No. PCT/JP2007/056215, dated Apr. 17, 2007.
Garg, R., et al. "Microstrip Slot Antennas", Microstrip Antenna Design Handbook, 2001, pp. 441-443, Artech House Inc., Norwood, MA.

* cited by examiner

*Primary Examiner*—Trinh V Dinh
(74) *Attorney, Agent, or Firm*—McDermott Will & Emery LLP

(57) ABSTRACT

With a differential feed line 103*c*, slot resonators 601, 603, 605, and 607 are allowed to operate in pair, a slot length of each resonator corresponding to a ½ effective wavelength during operation. Slot resonators which are excited out-of-phase with an equal amplitude are allowed to exist within the circuitry. Thus, positioning condition of selective radiation portions 601*b*, 601*c*, 603*b*, 603*c*, 605*b*, and 607*b* in the slot resonators is switched.

8 Claims, 24 Drawing Sheets

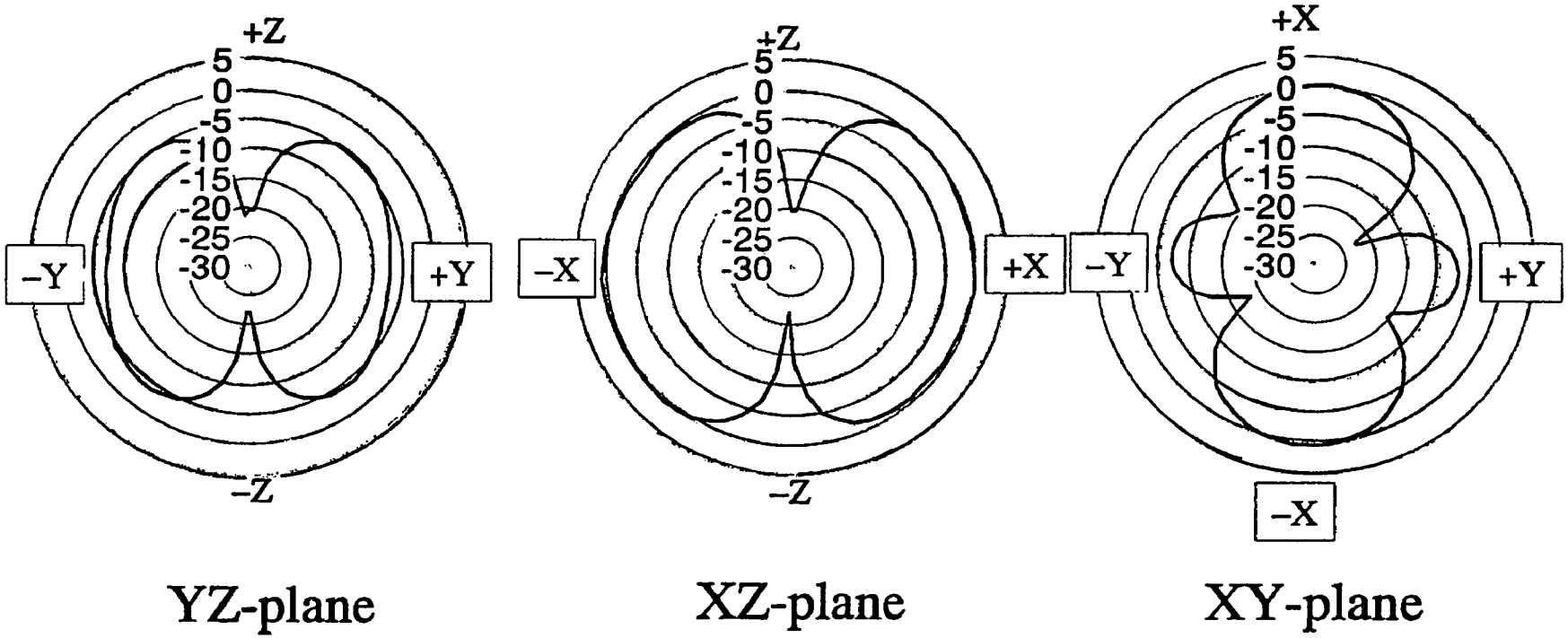
FIG.19A YZ-plane
FIG.19B XZ-plane
FIG.19C XY-plane

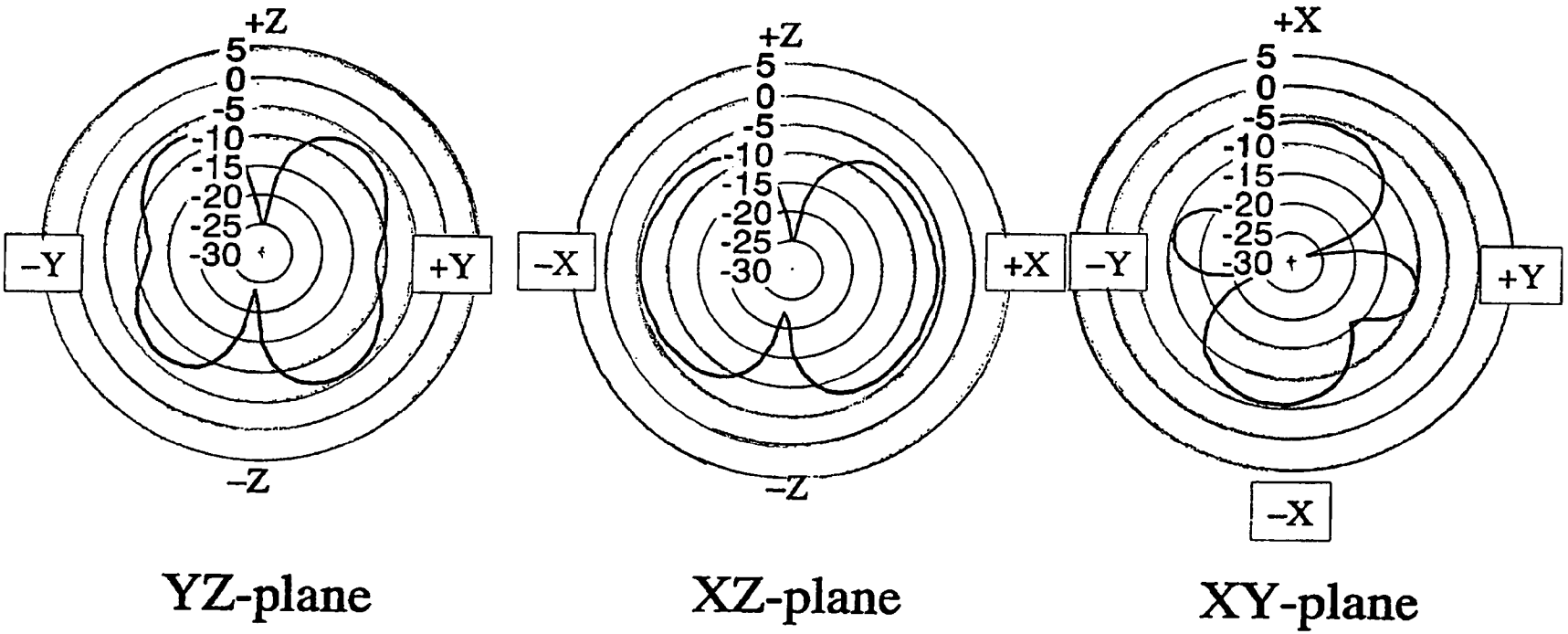
FIG.21A YZ-plane
FIG.21B XZ-plane
FIG.21C XY-plane

XY-plane

XZ-plane

YZ-plane

YZ-plane

XZ-plane

XY-plane

YZ-plane

XZ-plane

YZ-plane

XZ-plane

DIFFERENTIAL-FEED SLOT ANTENNA

This is a continuation of International Application No. PCT/JP2007/056215, with an international filing date of Mar. 26, 2007, which claims priority of Japanese Patent Application No. 2006-101741, filed on Apr. 3, 2006, the contents of which are hereby incorporated by reference.

BACKGROUND OF THE INVENTION

1. Field of the Invention

The present invention relates to a differentially-fed slot antenna with which a digital signal or an analog high-frequency signal, e.g., that of a microwave range or an extremely high frequency range, is transmitted or received.

2. Description of the Related Art

In recent years, drastic improvements in the characteristics of silicon-type transistors have led to an accelerated trend where compound semiconductor transistors are being replaced by silicon-type transistors not only in digital circuitry but also in analog high-frequency circuitry, and where analog high-frequency circuitry and digital baseband circuitry are being made into a single chip. As a result of this, single-ended circuits (which have been in the mainstream of high-frequency circuits) are being replaced by differential signal circuits which undergo a balanced operation of signals of positive and negative signs. This is because a differential signal circuit provides advantages such as drastic reduction in unwanted radiation, obtainment of good circuit characteristics under conditions which do not allow an infinite area of ground conductor to be disposed within a mobile terminal device, and so on.

The individual circuit elements in a differential signal circuit need to operate under a balance. Silicon-type transistors do not have much variation in characteristics, and make it possible to maintain a differential balance between signals. Another reason is that differential lines are also preferable for avoiding the loss that is associated with the silicon substrate itself. This has resulted in a strong desire for high-frequency devices, such as antennas and filters, to support differential signal feeding while maintaining the high high-frequency characteristics that have been established in single-ended circuits.

FIG. 26A shows a schematic see-through view as seen from the upper face. FIG. 26B shows a cross-sectional structural diagram taken along line A1-A2 in the figure. This is a ½ wavelength slot antenna (Conventional Example 1) which is fed through a single-ended line 103.

On a ground conductor surface 105 which is formed on the rear face of a dielectric substrate 101, a slot resonator 111A having a slot length Ls corresponding to a ½ effective wavelength is formed. In order to satisfy the input matching conditions, a distance Lm from an open-end point 113 of the single-ended line 103 until intersecting the slot 111A is set to a ¼ effective wavelength at the operating frequency. The slot resonator 111A is obtained by removing the conductor completely across the thickness direction in a partial region of the ground conductor surface 105.

As shown in the figure, a coordinate system is defined in which a direction that is parallel to a transmission direction in the feed line is the X axis and the plane of the dielectric substrate is the XY plane.

Typical examples of radiation directivity characteristics of Conventional Example 1 are shown in FIGS. 27A and 27B. FIG. 27A shows a radiation directivity in the YZ plane, whereas FIG. 27B shows a radiation directivity in the XZ plane. As is clear from these figures, Conventional Example 1 provides radiation directivity characteristics that exhibit a maximum gain in the ±Z direction. Null characteristics are obtained in the ±X direction, and even in the ±Y direction, a gain reduction effect of about 10 dB relative to the main beam direction is obtained.

U.S. Pat. No. 6,765,450 (hereinafter "Patent Document 1") discloses a circuit structure in which the aforementioned slot structure is disposed immediately under a differential feed line so as to be orthogonal to the transmission direction (Conventional Example 2). That is, the circuit construction of Patent Document 1 is a construction in which the circuit for feeding the slot resonator is changed from a single-ended line to a differential feed line.

The construction described in Patent Document 1 has an objective to realize a function of selectively reflecting only an unwanted in-phase signal that has been unintendedly superposed on a differential signal. As is clear from this objective, the circuit structure disclosed in Patent Document 1 does not have a function of radiating a differential signal into free space.

FIGS. 28A and 28B schematically illustrate field distributions occurring in a ½ wavelength slot resonator in the cases where it is fed through a single-ended line and a differential feed line, respectively.

In the case of the slot being fed through a single-ended line, electric fields 201 are distributed along the slot width direction so that a minimum intensity exists at both ends and a maximum intensity exists in the central portion. On the other hand, in the case of the slot being fed through a differential feed line, electric fields 201*a* which occur in the slot due to a voltage of the positive sign and electric fields 201*b* which occur in the slot due to a voltage of the negative sign are at an equal intensity and have vectors in opposite directions. Thus, in total, both electric fields cancel out each other, so that no resonance phenomenon occurs. Therefore, even the ½ wavelength slot resonator is fed through a differential feed line, efficient radiation of electromagnetic waves would be impossible according to principles. Therefore, as compared to the case of feeding via a single-ended line, it is not easy to realize antenna characteristics by allowing a differential feed line to couple to a ½ wavelength slot resonator.

In general, in order to efficiently radiate electromagnetic waves from a differential transmission circuit, no slot resonator is used. Rather, a method is employed in which the interspace between two signal lines of a differential feed line is gradually increased to realize a operation as a dipole antenna (Conventional Example 3).

FIG. 29A shows a perspective schematic see-through view of a differentially-fed strip antenna; FIG. 29B shows an upper schematic view thereof; and FIG. 29C shows a lower schematic view thereof. In FIGS. 29A to 29C, coordinate axes are set similarly to FIG. 26.

In a differentially-fed strip antenna, the line interspace of a differential feed line 103*c* which is formed on the upper face of a dielectric substrate 101 has a tapered increase at the ends. At the rear face side of the dielectric substrate 101, a ground conductor 105 is formed in a region 115*a* which is closer to the input terminal, whereas no ground conductor is formed in a region 115*b* lying immediately under the ends of the differential feed line 103*c*.

Typical examples of radiation directivity characteristics of Conventional Example 3 are shown in FIGS. 30A and 30B. FIG. 30A shows radiation directivity characteristics in the YZ plane, whereas FIG. 30B shows radiation directivity characteristics in the XZ plane.

As is clear from these figures, in Conventional Example 3, the main beam direction is the ±X direction, and Conventional Example 3 exhibits radiation characteristics with a broad half-width distributed over the XZ plane. According to principles, no radiation gain in the ±Y direction is obtained in Conventional Example 3. Radiation in the minus X direction can be suppressed due to the reflection from the ground conductor 105.

Japanese Laid-Open Patent Publication No. 2004-274757 (hereinafter "Patent Document 2") discloses a variable slot antenna which is fed through a single-ended line. FIG. 1 of Patent Document 2 is shown herein as FIG. 31.

This construction is similar to Conventional Example 1 in that a ½ wavelength slot resonator 5 which is formed on the substrate rear face is fed through a single-ended line 6 which is disposed on the front face of the dielectric substrate 10. However, at the leading end of the ½ wavelength slot resonator 5 being fed, a plurality of ½ wavelength slot resonators 1, 2, 3, and 4 are further provided for selective connection, thus realizing highly-free slot resonator positioning. It is described that changing the slot resonator positioning realizes a function of changing the main beam direction of electromagnetic waves (Conventional Example 4). (Non-Patent Document 1: Artech House Publishers "Microstrip Antenna Design Handbook" pp. 441-pp. 443 2001)

Conventional differentially-fed antennas, slot antennas, and variable antennas have the following problems associated with their principles.

Firstly, in Conventional Example 1, the main beam can only be directed in the ±Z axis direction, and it is difficult to direct the main beam direction in the ±Y axis direction or the ±X axis direction. What is more, since differential feeding is not yet supported, it is necessary to employ a balun circuit for feed signal conversion, thus resulting in the problems of increased elements, hindrance of integration, and the like.

Secondly, the ½ wavelength slot resonator of Conventional Example 2, in which feeding via a single-ended line is merely replaced with feeding via a differential feed line, can only acquire non-radiation characteristics. Thus, it is difficult to obtain an efficient antenna operation.

Thirdly, with Conventional Example 3, it is difficult to direct the main beam in the ±Y axis direction. Note that bending the feed line in order to deflect the main beam direction is not an available solution in Conventional Example 3 because, if the differential line is bent, the reflection of an unwanted in-phase signal will occur due to a phase difference between the two wiring lines at the bent portion. As an antenna for a mobile terminal device to be used in an indoor environment, it is highly unpreferable that the main beam cannot be directed in a certain direction.

Fourthly, the radiation characteristics of Conventional Example 3 have a broad half-width, which makes it difficult to avoid deterioration in quality of communications. For example, if a desired signal comes in the Z axis direction, the reception intensity of any unwanted signal that comes in the +X direction will not be suppressed. Thus, it is very difficult to avoid serious multipath problems which may occur when performing high-speed communications in an indoor environment with a lot of signal returns, and maintain the quality of communications in a situation where a lot of interference waves may arrive.

Fifthly, as in the aforementioned fourth problem, it is also difficult in Conventional Example 4 to prevent the quality of communications from being unfavorably affected by an unwanted signal coming in a direction which is different from the direction in which a desired signal arrives. In other words, even if the main beam direction is controllable, there is still a problem of inadequate suppression of interference waves. Of course, as in the aforementioned first problem, differential feeding is not yet supported.

In summary, by using any of the conventional techniques, it is impossible to realize a variable antenna which simultaneously solves the following three problems: 1) affinity with differential feed circuitry; 2) ability to switch the main beam direction within a broad range of solid angles; and 3) suppression of interference waves coming in any direction other than the main beam direction.

SUMMARY OF THE INVENTION

It is an objective of the present invention to provide a variable antenna which simultaneously solves the aforementioned three problems of the conventional techniques.

A differentially-fed variable slot antenna according to the present invention is a differentially-fed variable slot antenna comprising: a dielectric substrate; a ground conductor surface provided on a rear face of the dielectric substrate; a differential feed line disposed on a front face of the dielectric substrate, the differential feed line being composed of two mirror symmetrical signal conductors; a first slot resonator formed on the ground conductor surface; and a second slot resonator formed on the ground conductor surface, wherein, a portion of the first slot resonator intersects one of the two mirror symmetrical signal conductors but does not intersect the other signal conductor; a portion of the second slot resonator does not intersect the one signal conductor among the two mirror symmetrical signal conductors but intersects the other signal conductor; a slot length of the first slot resonator corresponds to a ½ effective wavelength at an operating frequency; a slot length of the second slot resonator corresponds to the ½ effective wavelength at the operating frequency; the two mirror symmetrical signal conductors are fed out-of-phase; at least one of the first slot resonator and the second slot resonator has at least one of an RF structure reconfigurability function and an operation status switching function, thus realizing a radiation characteristics reconfigurable effect resulting into at least two states; the first and second slot resonators each comprise a series connection structure in which a feeding portion partly intersecting the signal conductor is connected in series to a selective radiation portion not intersecting the signal conductor; in the at least one of the first and second slot resonators having the at least one function, a selective conduction path for controlling connection between the feeding portion and the selective radiation portion is inserted between the feeding portion and the selective radiation portion; in the at least one of the first and second slot resonators having the RF structure reconfigurability function, a plurality of said selective radiation portions are connected to the feeding portion each in series connection, and the selective conduction paths are controlled so that only one selective radiation portion among the plurality of selective radiation portions is connected to the feeding portion in an operating state; and in the at least one of the first and second slot resonators having the operation status switching function, the selective conduction path is controlled so that connection between the feeding portion and the selective radiation portion is terminated in a non-operating state.

In a preferred embodiment, the first slot resonator and the second slot resonator are each fed at a point whose distance from an open end of the differential feed line toward the feed circuit corresponds to a ¼ effective wavelength at the operating frequency.

In a preferred embodiment, an end point of the differential feed line is grounded via resistors of a same resistance value.

In a preferred embodiment, an end point of the first signal conductor and an end point of the second signal conductor are electrically connected to each other via a resistor.

In a preferred embodiment, one of the at least two states resulting from the radiation characteristics reconfigurable effect is a radiation directivity such that a main beam is directed in a direction having a component in a direction parallel to the differential feed line, the radiation directivity being realized by: designating two pairs of slot resonators, in each of which a first central portion of a first selective radiation portion of the first slot resonator and a second central portion of a second selective radiation portion of the second slot resonator are disposed at a distance of less than a ¼ effective wavelength at the operating frequency from each other; disposing the first central portion in the first pair of slot resonators and the first central portion in the second pair of slot resonators so as to be apart by about ½ effective wavelength at the operating frequency; and disposing the second central portion in the first pair of slot resonators and the second central portion in the second pair of slot resonators so as to be apart by about ½ effective wavelength at the operating frequency.

In a preferred embodiment, one of the at least two states resulting from the radiation characteristics reconfigurable effect is a radiation directivity realized by disposing a first central portion of a first selective radiation portion of the first slot resonator and a second central portion of a second selective radiation portion of the second slot resonator so as to be apart by about ½ effective wavelength at the operating frequency, the radiation directivity being such that a main beam is directed in a first direction connecting between the first central portion and the second central portion, and that a radiation gain in a direction of a plane which is orthogonal to the first direction is suppressed.

In a preferred embodiment, the first direction has a component which is orthogonal to a feeding direction of the differential feed line.

In a preferred embodiment, one of the at least two states resulting from the radiation characteristics reconfigurable effect is a radiation directivity realized by disposing a first central portion of a first selective radiation portion of the first slot resonator and a second central portion of a second selective radiation portion of the second slot resonator so as to be at a distance of less than a ¼ effective wavelength at the operating frequency from each other, the radiation directivity being such that a main beam is directed in a direction which is orthogonal to the dielectric substrate, and that a directivity with respect to a second direction connecting between the first central portion and the second central portion is suppressed.

A differentially-fed slot antenna according to the present invention simultaneously attains the following three effects: firstly, efficient radiation is obtained in directions which are not available with conventional differentially-fed antennas; secondly, the main beam direction is variable within a broad range of solid angles; and thirdly, according to natural principles, gain suppression is realized in at least two directions that are different from the main beam direction. Therefore, the antenna is very useful as an antenna for a mobile terminal device to be used in an indoor environment for high-speed communications purposes.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 2A is a cross-sectional structural diagram taken along line A1-A2 in FIG. 1. FIG. 2B is a cross-sectional structural diagram taken along line B1-B2 in FIG. 1. FIG. 2C is a cross-sectional structural diagram taken along line C1-C2 in FIG. 1.

FIGS. 5A and 5B are structural diagrams of slot resonators which emerge owing to an RF structure reconfigurability function. FIG. 5C is a structural diagram of a slot resonator which is controlled to a non-operating state by an operation status switching function.

FIG. 15A is a schematic see-through structural diagram. FIG. 15B is a schematic structural diagram showing a slot pattern which is formed on a ground conductor.

FIG. 16A is a schematic structural diagram showing positioning of chip capacitors. FIG. 16B is a schematic structural diagram showing a slot pattern which is realized in high-frequency terms.

FIG. 18A is an overall view as seen from above an upper face. FIG. 18B is an enlarged view of a slot resonator.

FIGS. 19A, 19B, and 19C are radiation directivity characteristics diagrams of an Example of the present invention in a first operating state at 5.25 GHz. FIG. 19A is a radiation directivity characteristics diagram in the YZ plane. FIG. 19B is a radiation directivity characteristics diagram in the XZ plane. FIG. 19C is a radiation directivity characteristics diagram in the XY plane.

FIGS. 21A, 21B, and 21C are radiation directivity characteristics diagrams of an Example of the present invention in a first operating state at 5.25 GHz. FIG. 21A is a radiation directivity characteristics diagram in the YZ plane. FIG. 21B is a radiation directivity characteristics diagram in the XZ plane. FIG. 21C is a radiation directivity characteristics diagram in the XY plane.

FIG. 22A is an overall view as seen from above an upper face. FIG. 22B is an enlarged view of a slot resonator.

FIG. 23A is a radiation directivity characteristics diagram in the YZ plane. FIG. 23B is a radiation directivity characteristics diagram in the XZ plane. FIG. 23C is a radiation directivity characteristics diagram in the XY plane.

FIG. 25A is a radiation directivity characteristics diagram in the YZ plane. FIG. 25B is a radiation directivity characteristics diagram in the XZ plane. FIG. 25C is a radiation directivity characteristics diagram in the XY plane.

FIG. 26A is an upper schematic see-through view. FIG. 26B is a cross-sectional structural diagram.

FIG. 27A is a radiation directivity characteristics diagram in the YZ plane. FIG. 27B is a radiation directivity characteristics diagram in the XZ plane.

FIG. 28A is a schematic diagram in the case of feeding through a single-ended feed line. FIG. 28B is a schematic diagram in the case of feeding through a differential feed line.

FIG. 29A is a perspective schematic see-through view. FIG. 29B is an upper schematic view.

FIG. 30A is a radiation directivity characteristics diagram in the YZ plane. FIG. 30B is a radiation directivity characteristics diagram in the XZ plane.

DETAILED DESCRIPTION OF PREFERRED EMBODIMENTS

Hereinafter, an embodiment of the differentially-fed slot antenna according to the present invention will be described with reference to the drawings. The differentially-fed slot antenna according to the following embodiment is able to realize efficient radiation in directions in which conventional differentially-fed antennas cannot provide radiation, and is able to switch the main beam direction to various directions. Furthermore, it is also possible to suppress the radiation gain in a plurality of directions which are different from the main beam direction.

Embodiment

Figure 1:
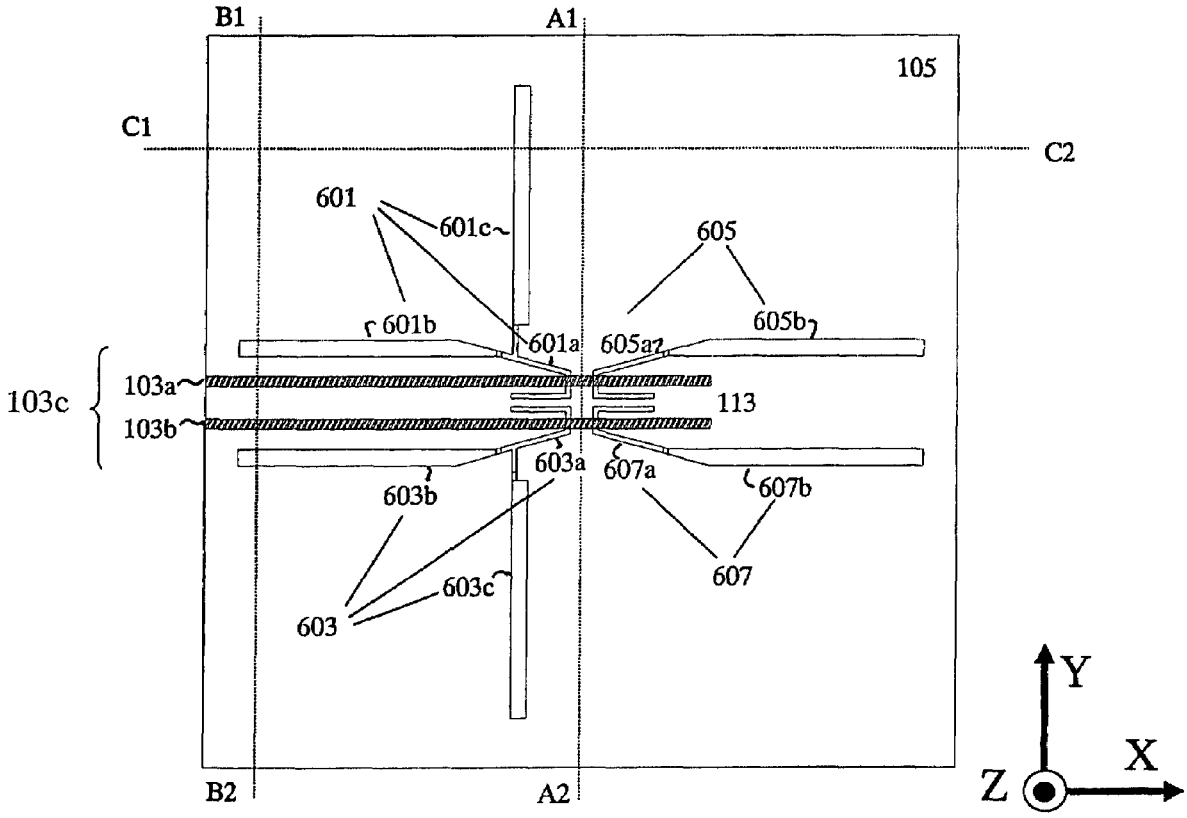
FIG. 1 is a schematic see-through view of an embodiment of the differentially-fed slot antenna according to the present invention as seen from above an upper face.

FIG. 1 shows an embodiment of the differentially-fed slot antenna according to the present invention, and provides a schematic see-through view as seen through a ground conductor on the rear face of a dielectric substrate.

Figure 2A:
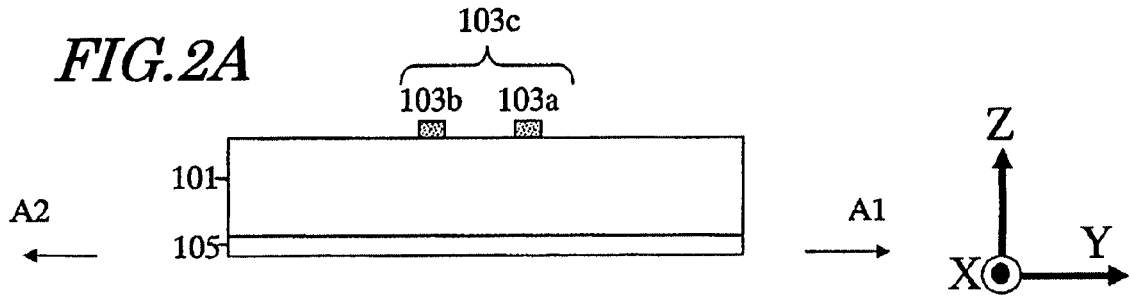
FIGS. 2A, 2B, and 2C are cross-sectional structural diagrams of the differentially-fed slot antenna embodiment of FIG. 1.
Figure 2B:
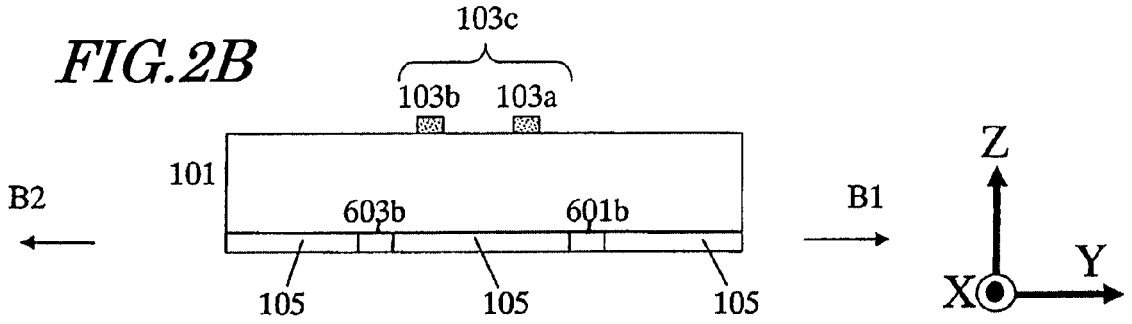
Figure 2C:
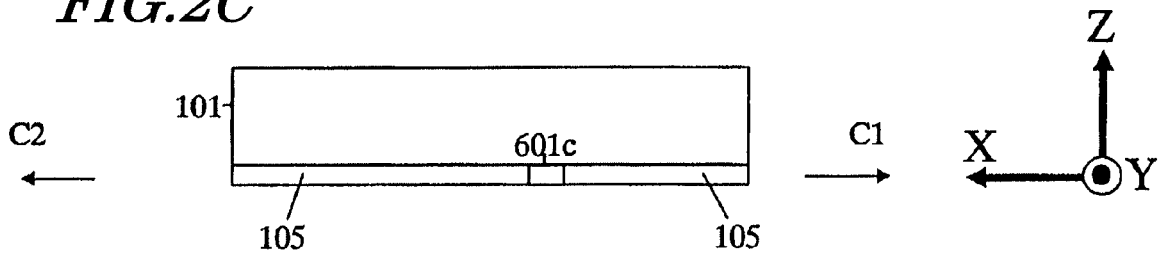

FIGS. 2A to 2C are cross-sectional structural diagrams of the circuit structure taken along line A1-A2, line B1-B2, and line C1-C2 in FIG. 1, respectively. The coordinate axes and signs in the figures correspond to the coordinate axes and signs in FIGS. 26A and 26B and FIGS. 29A and 29B showing constructions and radiation directions of Conventional Examples.

Referring to FIG. 1, a ground conductor 105 is formed on the rear face of a dielectric substrate 101, and a differential feed line 103*c* is formed on the front face of the dielectric substrate 101. The differential feed line 103*c* is composed of a mirror symmetrical pair of signal conductors 103*a* and 103*b*. In partial regions of the ground conductor 105, the conductor is removed completely across the thickness direction to form slot circuits. Specifically, four slot resonators 601, 603, 605, and 607 are provided in the ground conductor 105.

Figure 3:
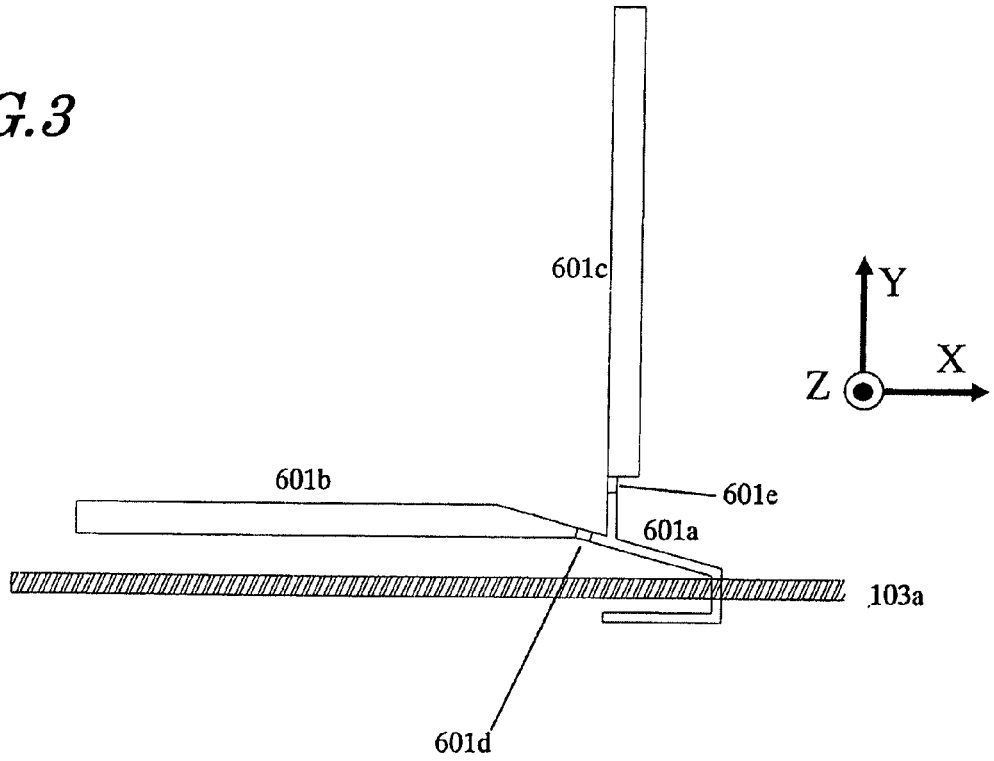
FIG. 3 is an enlarged view showing the neighboring structure of a slot resonator 601.

FIG. 3 is an enlarged view of the neighborhood of the slot resonator 601, which is capable of realizing both of an RF structure reconfigurability function and an operation status switching function. As shown in FIG. 3, the slot resonator 601 includes a feeding portion 601*a* which is in series connection to each of selective radiation portions 601*b* and 601*c*. Among the plurality of slot resonators 601, 603, 605, and 607, at least one slot resonator realizes at least one of the RF structure reconfigurability function and the operation status switching function in a variable manner, in response to an external control signal.

In order to realize such functions, the external control signal controls a high-frequency switching element 601*d* which is disposed between the feeding portion 601*a* and the selective radiation portion 601*b*, and also controls a high-frequency switching element 601*e* which is disposed between the feeding portion 601*a* and the selective radiation portion 601*c*.

Figure 4:
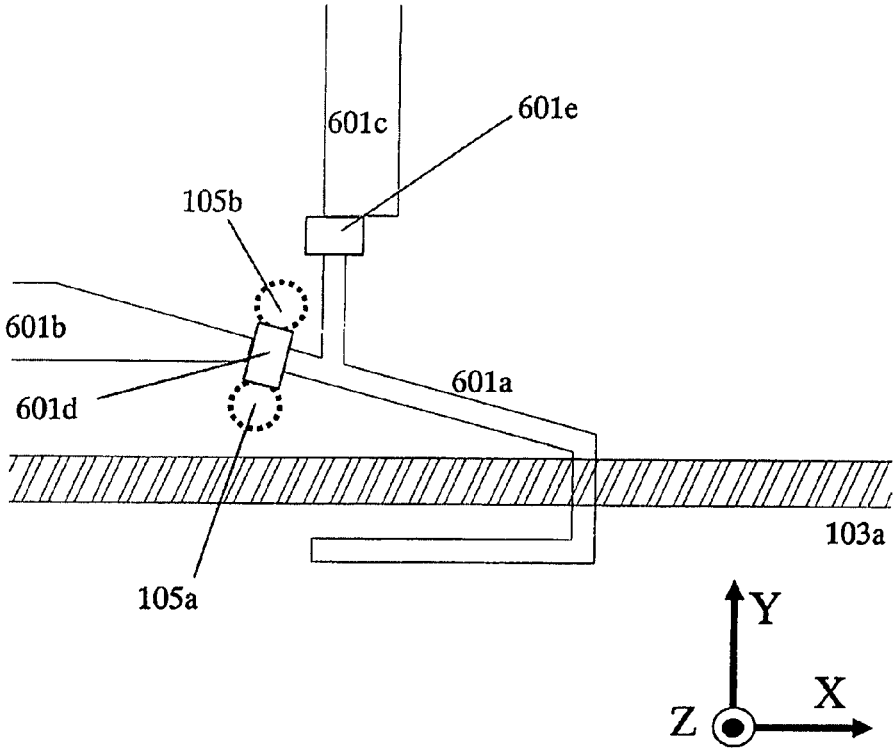
FIG. 4 is an enlarged structural diagram within the slot resonator 601.

FIG. 4 is an enlarged view near the high-frequency switching elements 601*d* and 601*e*. The high-frequency switching element 601*d* provides control as to whether or not to connect between ground conductor regions 105*a* and 105*b* which are on both sides astride the slot. When the high-frequency switching element 601*d* is controlled to be in an open state, connection between the feeding portion 601*a* and the selective radiation portion 601*b* is maintained. On the other hand, when the high-frequency switching element 601*d* is controlled to be in a conducting state so as to terminate connection between the feeding portion 601*a* and the selective radiation portion 601*b*, the selective radiation portion 601*b* can be isolated from the slot resonator structure.

Thus, each slot resonator having the RF structure reconfigurability function includes at least two selective radiation portions. However, the number of selective radiation portions to be selected within the slot resonator during operation is limited to one. The remaining unselected selective radiation portion is isolated from the slot resonator in high-frequency terms.

Figure 5B:
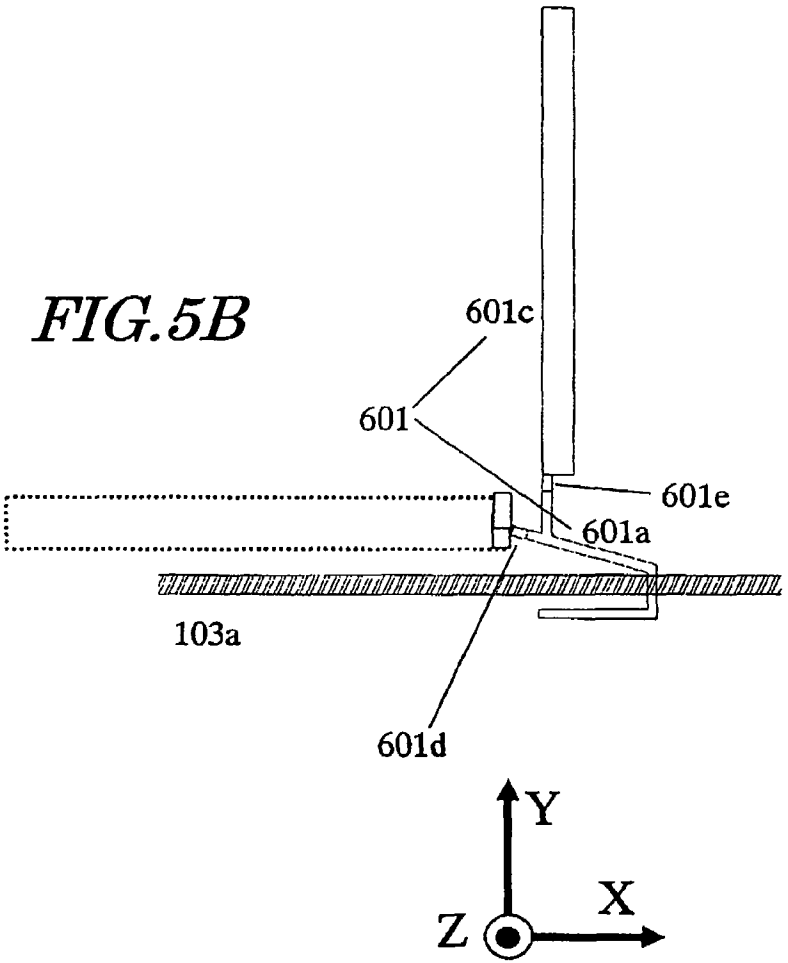
FIGS. 5A, 5B, and 5C are diagrams showing examples of reconfigurability of the slot resonator 601.
Figure 5A:
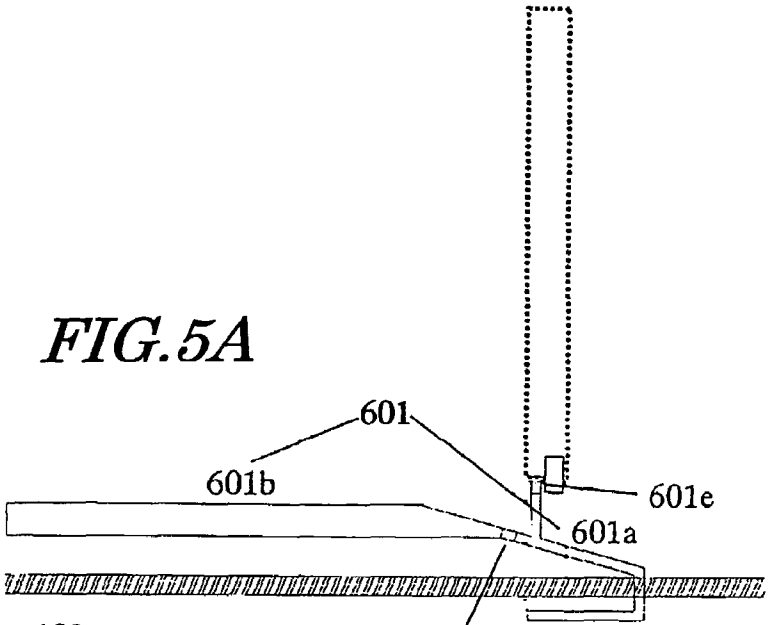
Figure 5C:
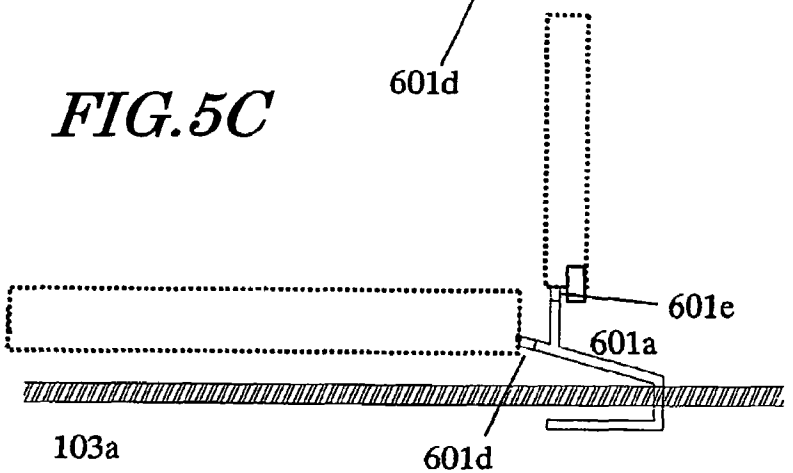

FIGS. 5A to 5C show examples of changing high-frequency structures of the slot resonator 601 in FIG. 3. In FIGS. 5A to 5C, each unselected selective radiation portion is obscured.

In the example shown in FIG. 5A, the high-frequency switching element 601*d* is open, whereas the high-frequency switching element 601*e* is conducting. As a result, connection between the feeding portion 601*a* and the selective radiation portion 601*c* is terminated, so that the slot resonator has a structure in which the feeding portion 601*a* and the selective radiation portion 601*b* are connected in series.

On the other hand, in the example shown in FIG. 5B, the high-frequency switching element 601*d* is conducting, whereas the high-frequency switching element 601*e* is open. As a result, connection between the feeding portion 601*a* and the selective radiation portion 601*b* is terminated, so that the slot resonator has a structure in which the feeding portion 601*a* and the selective radiation portion 601*c* are connected in series.

The operation status switching function is a function to enable switching between an operating state and a non-operating state. This function is realized by switching the state of the high-frequency switching element that is present between a feeding portion and a selective radiation portion. FIG. 5C shows a structure in the case where the slot resonator 601 of FIG. 3 is switched to a non-operating state. By controlling both of the two high-frequency switching elements 601*d* and 601*e* in a conducting state, all of the selective radiation portions that are connected to the feeding portion 601*a* are isolated from the slot resonator in high-frequency terms.

On the other hand, in an operating state, only one of the plurality of selective radiation portions is to be connected to the feeding portion 601*a*, as shown in FIGS. 5A and 5B. Note that the present invention does not contemplate a state where both selectively conducting means 601*d* and 601*e* are controlled to be in an open state.

Table 1 summarizes combinations of manners of controlling the high-frequency switching elements 601*d* and 601*e* in relation to changes in the high-frequency circuit structure of the slot resonator 601.

TABLE 1

| | high-frequency switching element | | slot resonator construction | | |
|---|---|---|---|---|---|
| FIG. | 601d | 601e | operating/non-operating | feeding portion | selective radiation portion |
| 5A | open | conducting | operating | ○ | 601b |
| 5B | conducting | open | operating | ○ | 601c |
| 5C | conducting | conducting | non-operating | — | — |

The effective electrical lengths of the feeding portion and each selective radiation portion are prescribed so that the slot length of every slot resonator that is in an operating state always equals a ½ effective wavelength. Preferably, the length of the feeding portion is much shorter than the length of each selective radiation portion.

The slot resonators according to the present embodiment always operate in a pair structure. In other words, the state of each slot resonator is controlled so that the number N1 of slot resonators that are coupled to the first signal conductor 103*a* so as to be in an operating state and the number N2 of slot resonators that are coupled to the second signal conductor 103*b* so as to be in an operating state are equal. Specifically, with respect to the construction of FIG. 1, combinations of slot resonators that can operate in a pair structure and combinations of slot resonators that cannot operate in a pair structure are summarized in Table 2.

TABLE 2

| | |
|---|---|
| Those which can form a pair structure | slot resonator 601 & slot resonator 603<br>slot resonator 605 & slot resonator 607<br>slot resonator 601 & slot resonator 607<br>slot resonator 603 & slot resonator 605 |
| Those which cannot be regarded as forming a pair structure | slot resonator 601 & slot resonator 605<br>slot resonator 603 & slot resonator 607 |

The selective radiation portions of each slot resonator of the present embodiment are disposed so as to be, as viewed from the plane of mirror symmetry between the pair of signal conductors (i.e., the plane between the signal conductor 103*a* and the signal conductor 103*b* in FIG. 1), on the side where the signal conductor which is coupled to the feeding portion is located. For example, since the feeding portion 601*a* of the first slot resonator 601 is coupled to the first signal conductor 103*a*, the selective radiation portions 601*b* and 601*c* are to be disposed in the direction of the first signal conductor 103*a* as viewed from the plane of mirror symmetry of the signal conductors.

It is ensured that those slot resonators which operate in pair receive an equal intensity of power to be fed from the two signal conductors 103*a* and 103*b*. In order to satisfy this condition, the slot resonators which operate in pair may be disposed physically mirror symmetrical with respect to the two signal conductors 103*a* and 103*b*.

Even in the case where a given pair of slot resonators are not disposed physically mirror symmetrical, similar effects can be realized by ensuring that the high-frequency characteristics of the pair of slot resonators are symmetrical. In other words, it suffices if those slot resonators which operate in pair have an equal resonant frequency and are coupled to the respective signal conductors with an equal intensity of coupling.

<Variability of Main Beam Orientation Based on Variability of Slot Shape>

Hereinafter, a method according to the present embodiment for controlling the slot resonators into three states, i.e., the main beam direction being oriented in the ±X direction, ±Y direction, or ±Z direction, will be described.

The radiation characteristics of the differentially-fed slot antenna according to the present embodiment are approximated to the radiation characteristics of an array antenna in which a plurality of antenna elements are arranged. In this case, the radiation source of each antenna element is an electric field vector element occurring in the center portion of each selected selective radiation portion.

The radiation characteristics of an array antenna in a direction along a predetermined coordinate axis are determined by the following three factors.

A first factor is an effective distance between antenna elements, as taken along the predetermined coordinate axis. A second factor is a phase difference between electric field vector elements which are excited in the respective antenna elements. A third factor is the radiation intensity from each antenna element.

Taking two antenna elements for instance, when the electromagnetic wave components radiated from both elements arrive at a predetermined coordinate axis point in infinity, it may be assumed that a phase difference of θ1 degrees occurs because of the first factor and a phase difference of θ2 degrees occurs because of the second factor. Because of the first and second factors, at a point in infinity along the coordinate axis of interest, the electromagnetic wave components which are radiated from both antenna elements are merged with a phase difference of θs degrees, which is a sum of θ1 and θ2.

When establishing a condition where the absolute value of θs is no less than 0° and no more than 90°, and is preferably 0°, the electromagnetic wave components which are radiated from both elements will be added at a point in infinity, thus causing an increase in radiation gain along the predetermined coordinate axis direction. On the other hand, when establishing a condition where the absolute value of θs is no less than 90° and no more than 180°, and is preferably 180°, the electromagnetic wave component radiated from both elements will cancel out each other, thus causing a reduction in radiation gain along the predetermined coordinate axis direction.

Table 3 summarizes dependence, on the aforementioned three factors, of changes in radiation gain of the array antenna along the predetermined coordinate axis direction.

TABLE 3

| Combination | positioning condition θ1 | | excitation condition θ2 | | phase reached at point in infinity θs | | changes in radiation gain |
|---|---|---|---|---|---|---|---|
| 1 | 0° | in-phase positioning | 0° | in-phase excitation | 0° | in-phase | increased |
| 2 | 180° | out-of-phase positioning | 180° | out-of-phase excitation | 0° (=360°) | in-phase | |
| 3 | 0° | in-phase positioning | 180° | out-of-phase excitation | 180° | out-of-phase | reduced |
| 4 | 180° | out-of-phase positioning | 0° | in-phase excitation | 180° | out-of-phase | |

The slot resonators of the differentially-fed slot antenna of the present embodiment are fed in a pair structure, at an equal intensity. Therefore, the vector elements of the respective vector amplitudes can be set equal.

<Null Characteristics Acquisition Effect; Distinction Over Conventional Examples>

Next, realization of null characteristics, which is a unique effect of the present invention, will be described.

In Table 3, a special condition further exists in the relationships of Combinations 3 and 4 (where θs is 180° and reduction in radiation gain is obtained). Specifically, in the case where θs is 180° and there is no difference in amplitude between vector elements, the electromagnetic wave components at a point in infinity will be completely canceled, thus making it possible to forcibly suppress radiation. Since the amplitudes of all vector elements are set equal in the present differentially-fed slot antenna, null characteristics can be obtained in any direction in which either Combination 3 or 4 is established.

The directions in which null characteristics are obtained are at least two directions that are different from the main beam direction, which in a typical example are directions orthogonal to the directions main beam direction.

Figure 31:
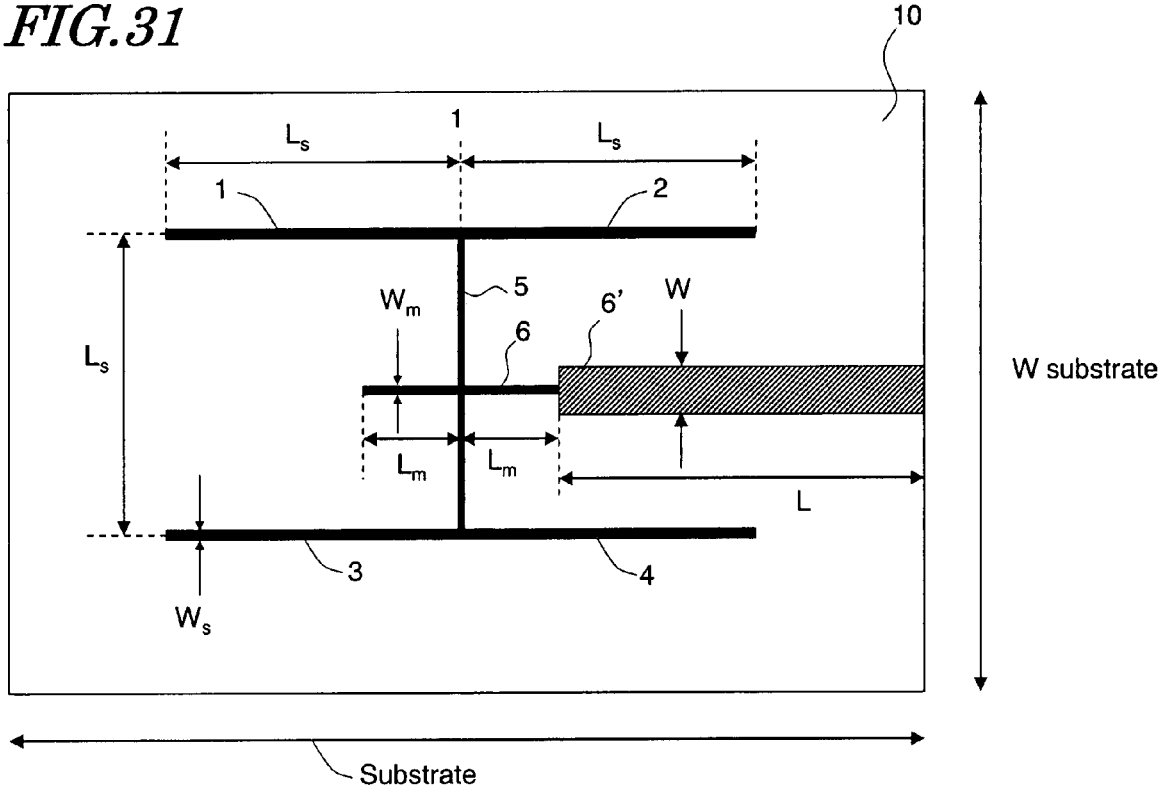
FIG. 31, which is FIG. 1 of Patent Document 2 (Conventional Example 4), is a schematic structural diagram of a single-ended feed variable antenna.

In Conventional Example 4 shown in FIG. 31, it is very difficult to set the vector amplitudes of electric field vector elements occurring in the antenna elements to an equal intensity. For example, it is difficult to ensure that the electric field vector element occurring in the fed slot resonator 5 and the electric field vector elements occurring in the connected slot resonators 1 to 4 have an equal amplitude. When there is asymmetry in amplitude between two vector elements, a gain increasing effect and a gain reduction effect may be easily obtained as described in Conventional Example 4, but null characteristics will not be obtained as easily as in the differentially-fed slot antenna according to the present invention.

The unique effect of the present invention, which cannot be obtained by Conventional Example 4, has been made clear from the above description.

Hereinafter, three typical operating states of orienting the main beam direction in the typical coordinate directions of the ±X direction, the ±Y direction, and the ±Z direction will be specifically described. It will also be described how effectively null characteristics are realized in each operating state.

<First Operating State: Orienting the Main Beam Direction in the ±X Direction>

First, as a first operating state, a method of controlling the slot resonators so that the main beam direction is oriented in the ±X direction while also suppressing the radiation gain in the ±Y direction and the ±Z direction will be described.

In the construction shown in FIG. 1, by selecting the selective radiation portions 601*b*, 603*b*, 605*b*, and 607*b* and unselecting the selective radiation portions 601*c* and 603*c* of the slot resonators 601, 603, 605, and 607, the first operating state can be realized.

Table 4 summarizes control states of the slot resonators in the first operating state.

TABLE 4

| slot resonator | operating/non-operating | construction | high-frequency switching element open | high-frequency switching element conducting |
|---|---|---|---|---|
| 601 | operating | 601a + 601b | 601d | 601e |
| 603 | operating | 603a + 603b | 603d | 603e |
| 605 | operating | 605a + 605b | 605d | |
| 607 | operating | 607a + 607b | 607d | |

Figure 6:
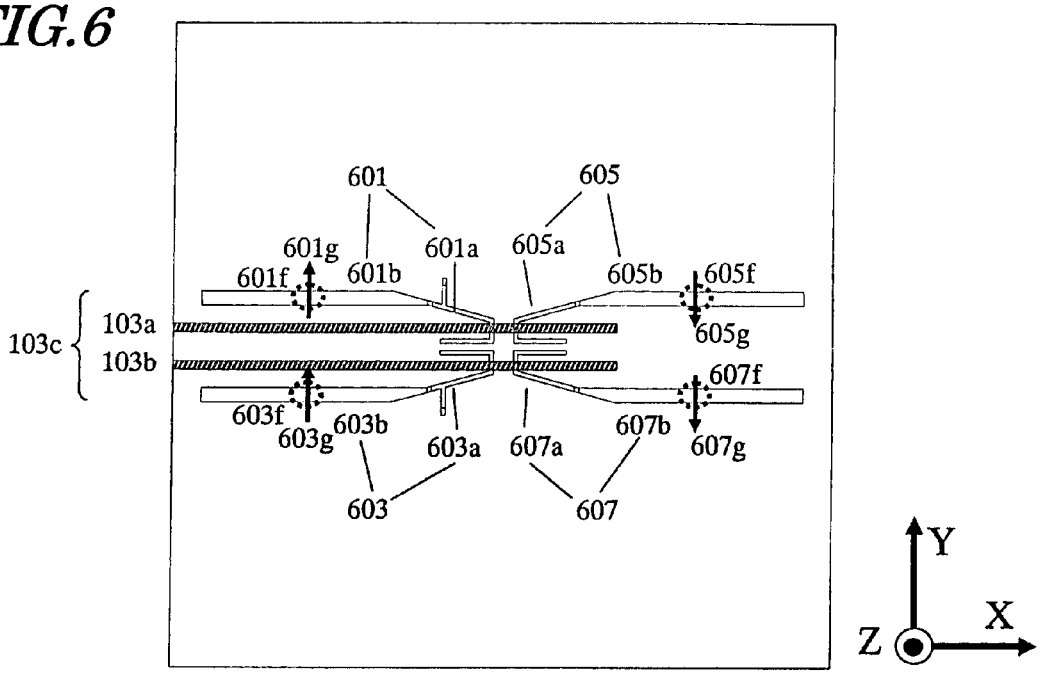
FIG. 6 is a structural diagram of a differentially-fed slot antenna according to the present invention in a first operating state.

In the first operating state, a high-frequency structure containing the four slot resonators 601, 603, 605, and 607 as shown in FIG. 6 emerges in the circuitry.

Hereinafter, the radiation characteristics from the antenna operating in the first operating state will be described. In the following, the radiation characteristics will be regarded as those of an array antenna whose antenna elements are field vector elements 601*g*, 603*g*, 605*g*, and 607*g* occurring at respective central portions 601*f*, 603*f*, 605*f*, and 607*f* of the selective radiation portions 601*b*, 603*b*, 605*b*, and 607*b* of the four slot resonators.

Table 5 summarizes the relationship among θ1, θ2, and θs between the field vector elements as viewed from a point in infinity along the X axis.

TABLE 5

| Combination | vector element | | θ1 | θ2 | θs | change in radiation intensity |
|---|---|---|---|---|---|---|
| 1 | 601 g | 605 g | 180° | 180° | 360°(=0°) | enhanced |
| 2 | 603 g | 607 g | | | | enhanced |
| 3 | 601 g | 607 g | | | | enhanced |
| 4 | 603 g | 605 g | | | | enhanced |
| 5 | 601 g | 603 g | 0° | 0° | 0° | enhanced |
| 6 | 605 g | 607 g | | | | enhanced |

By taking the field vector element 601*g* for example, an out-of-phase positioning/out-of-phase excitation condition exists with 605*g* and 607*g* in Combinations 1 and 3, and an in-phase positioning/in-phase excitation condition exists in Combination 5. In all of these combinations, the radiation gain is enhanced.

Similarly, for any field vector element other than the field vector element 601*g*, no condition exists that results in an out-of-phase θs value in the first operating state. Consequently, the radiation intensity is enhanced along the X axis direction. The reason why θ1 corresponds to substantially 180° in Combination 1, for example, is derived from the fact that the slot lengths of the slot resonators 601*b* and 605*b* are substantially a ½ effective wavelength.

Although θ1 is described as 180° for Combinations 1 to 4, this does not necessary mean that the center portions of selective radiation portions of slot resonators must be exactly 180° apart. Some gain enhancement effect can be expected when θ1 is 90° or more.

On the other hand, Table 6 summarizes the relationship among θ1, θ2, and θs between the field vector elements as viewed from a point in infinity along the Y axis.

Combinations 5 and 6 are under a condition where θs is 0° and the gain is doubled. However, at the same time, the four vector elements included in Combinations 5 and 6 satisfy an in-phase positioning and out-of-phase excitation condition in Combinations 1 to 4. Thus, a reduction in radiation gain is expected along the Y axis direction.

In the present differentially-fed slot antenna, there is no difference in amplitude between vector elements in each combination. Therefore, not only the radiation gain is reduced, but also null characteristics are obtained such that radiation is forcibly suppressed along the Y axis direction.

TABLE 6

| Combination | vector element | | θ1 | θ2 | θs | change in radiation intensity |
|---|---|---|---|---|---|---|
| 1 | 601 g | 605 g | 0° | 180° | 180° | suppressed |
| 2 | 603 g | 607 g | | | | |
| 3 | 601 g | 607 g | substantially | | | |
| 4 | 603 g | 605 g | 0° | | | |
| 5 | 601 g | 603 g | | 0° | 0° | — |
| 6 | 605 g | 607 g | | | | — |

Furthermore, Table 7 summarizes the relationship among θ1, θ2, and θs between the field vector elements as viewed from a point in infinity along the Z axis.

Combinations 5 and 6 are under a condition where θs is 0° and the radiation components from the vector elements contribute to enhancement of the radiation gain. However, at the same time, all vector elements also operate in pair in Combinations 1 to 4, which are under an in-phase positioning and out-of-phase excitation condition. As a whole, reduction in the radiation gain is expected along the Z axis direction.

In the present differentially-fed slot antenna, there is no difference in amplitude between vector elements in each combination. Therefore, not only the radiation gain is reduced, but also null characteristics are obtained such that radiation is forcibly suppressed along the Z axis direction.

TABLE 7

| Combination | vector element | | θ1 | θ2 | θs | change in radiation intensity |
|---|---|---|---|---|---|---|
| 1 | 601 g | 605 g | 0° | 180° | 180° | suppressed |
| 2 | 603 g | 607 g | | | | |
| 3 | 601 g | 607 g | | | | |
| 4 | 603 g | 605 g | | | | |
| 5 | 601 g | 603 g | | 0° | 0° | — |
| 6 | 605 g | 607 g | | | | — |

From the above results, in the first operating state, the radiation components from the respective slot resonators are under a condition where only the radiation components along the X axis direction are added, so that the main beam direction is oriented in the X axis direction, whereby the gain is suppressed along the Y axis and Z axis directions, which are orthogonal to the X axis direction. As a result, the half-width of the beam which is radiated along the X axis direction can also be suppressed.

Figure 7:
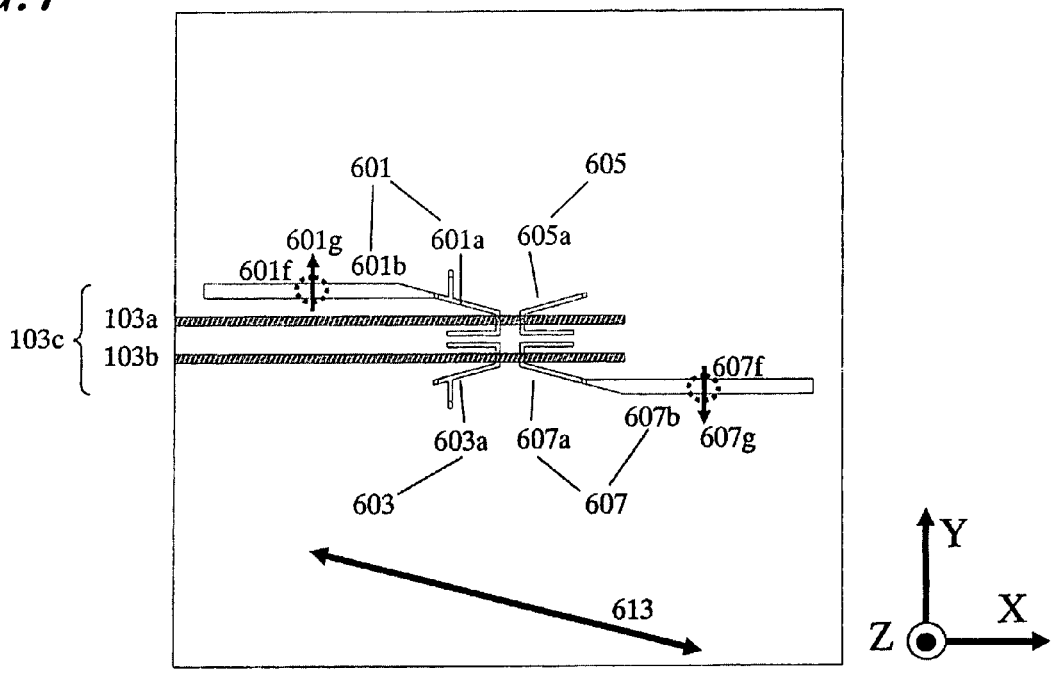
FIG. 7 is a structural diagram of a differentially-fed slot antenna according to the present invention in a first operating state.

FIG. 7 is construction diagram, using the construction of FIG. 1, illustrating an operating state for obtaining effects similar to those of the first operating state.

In the construction of FIG. 7, the number of pairs of slot resonators in operation is reduced from two to one. The slot resonators 601 and 607 contribute to the antenna operation, whereas the slot resonators 603 and 605 are controlled to a non-operating state. In the construction of FIG. 7, the main beam direction can be oriented in a direction 613 which is parallel to the direction that connects between the center portion 601*f* with the center portion 607*f*.

In this case, too, a gain suppression effect can be effectively obtained along directions which are substantially orthogonal to the main beam.

<Second Operating State: Orienting the Main Beam Direction in the ±Y Direction>

Next, as a second operating state, a method of controlling the slot resonators so that the main beam direction is oriented in the ±Y direction while also suppressing the radiation gain in the ±X direction and the ±Z direction will be described.

In the construction shown in FIG. 1, by selecting the selective radiation portions 601*c* and 603*c* and unselecting the selective radiation portions 601*b* and 603*b* of the slot resonators 601 and 603, and placing the slot resonators 605 and 607 in a non-operating state, the second operating state can be realized.

Figure 8:
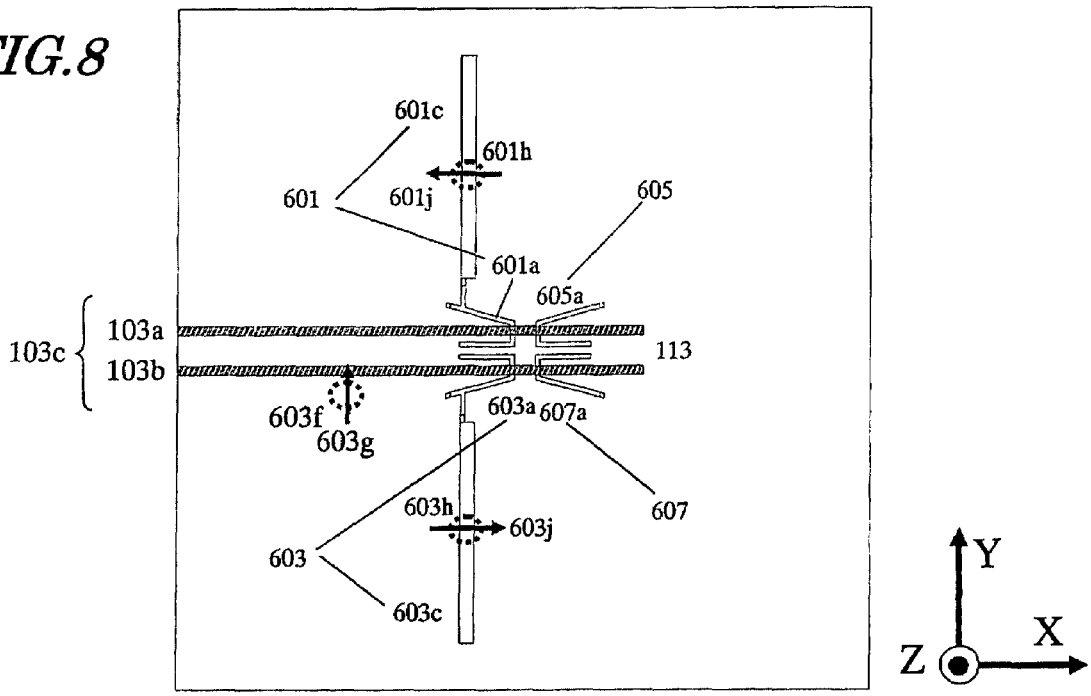
FIG. 8 is a structural diagram of a differentially-fed slot antenna according to the present invention in a second operating state.

FIG. 8 shows a structure in which, in the second operating state, those selective radiation portions which are unselected are omitted from the structure of FIG. 1. Table 8 summarizes control states of the slot resonators in the second operating state.

TABLE 8

| slot | | | high-frequency switching element | |
|---|---|---|---|---|
| resonator | operating/non-operating | construction | open | conducting |
| 601 | operating | 601a + 601c | 601e | 601d |
| 603 | operating | 603a + 603c | 603e | 603d |
| 605 | non-operating | — | | 605d |
| 607 | non-operating | | | 607d |

Hereinafter, the radiation characteristics from the antenna operating in the second operating state will be described. In the following, the radiation characteristics will be regarded as those of an array antenna whose antenna elements are field vector elements 601*j* and 603*j* occurring at respective central portions 601*h* and 603*h* of the selective radiation portions 601*c* and 603*c* of the two slot resonators.

Table 9 summarizes the relationship among θ1, θ2, and θs between the field vector elements as viewed from a point in infinity along each of the X axis, the Y axis, and the Z axis.

TABLE 9

| Combi-nation | coordinate direction | vector element | | θ1 | θ2 | θs | change in radiation intensity |
|---|---|---|---|---|---|---|---|
| 1 | X | 601j | 603j | 0° | 180° | 180° | suppressed |
| 2 | Y | | | 180° | | 0° (=360°) | enhanced |
| 3 | Z | | | 0° | | 180° | suppressed |

As is clear from Table 9, a condition is established where the radiation gain along the Y axis direction is enhanced and the radiation gain is suppressed along the X axis and Z axis directions. As a result, a highly useful radiation directivity is realized such that the main beam is oriented in the ±Y direction and null characteristics are obtained in the ±X and ±Z directions, which are orthogonal to the Y axis.

The ±Y direction, in which the main beam is directed in the second operating state, is a main beam direction which has been difficult to realize with conventional differentially-fed antennas. Since null characteristics are forcibly obtained along the orthogonal directions, the half-width of the main beam can be effectively reduced.

Note that the minimum construction that is necessary for realizing the second operating state is a pair of slot resonators. Therefore, the second operating state can also be realized with a construction which is obtained by eliminating altogether the slot resonators 605 and 607 from the circuit construction shown in FIG. 1.

Figure 9:
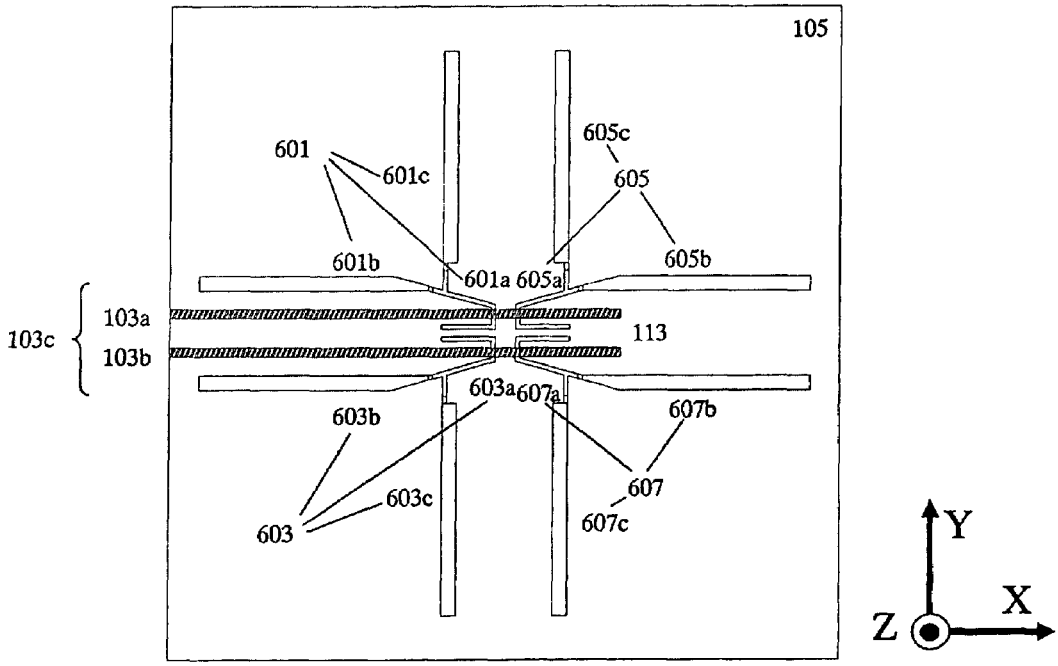
FIG. 9 is a schematic structural diagram of a differentially-fed slot antenna according to the present invention.

Instead of the construction shown in FIG. 1, a construction shown in FIG. 9 may be used, where every slot resonator includes a plurality of selective radiation portions. When controlling the construction shown in FIG. 9, the second operating state can be realized by various control methods, as exemplified in FIGS. 10 to 12.

Figure 10:
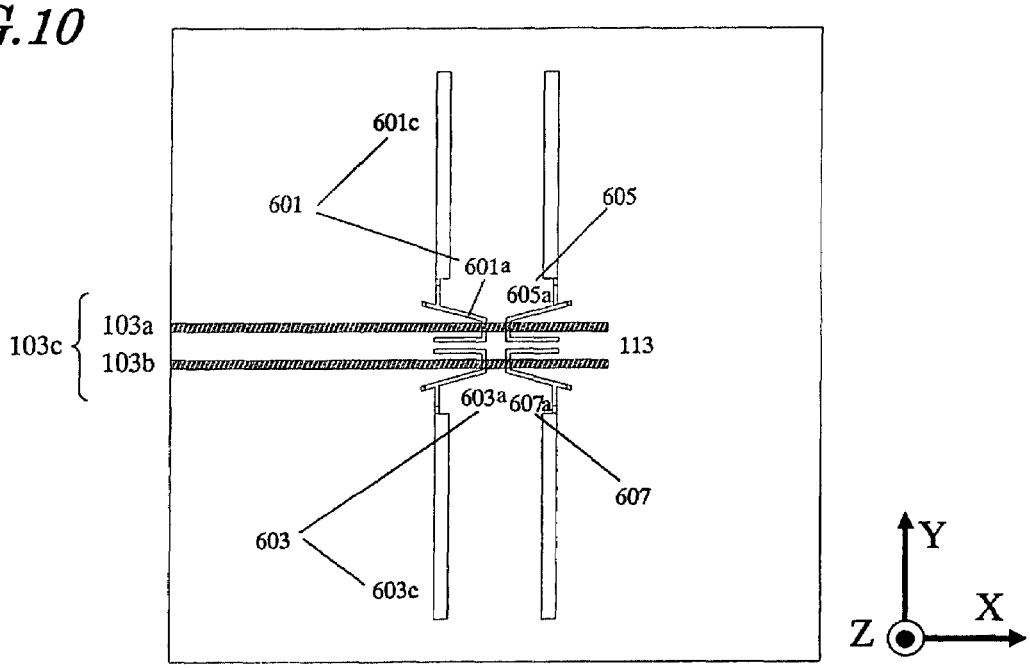
FIG. 10 is a structural diagram of a differentially-fed slot antenna according to the present invention in a second operating state.
Figure 11:
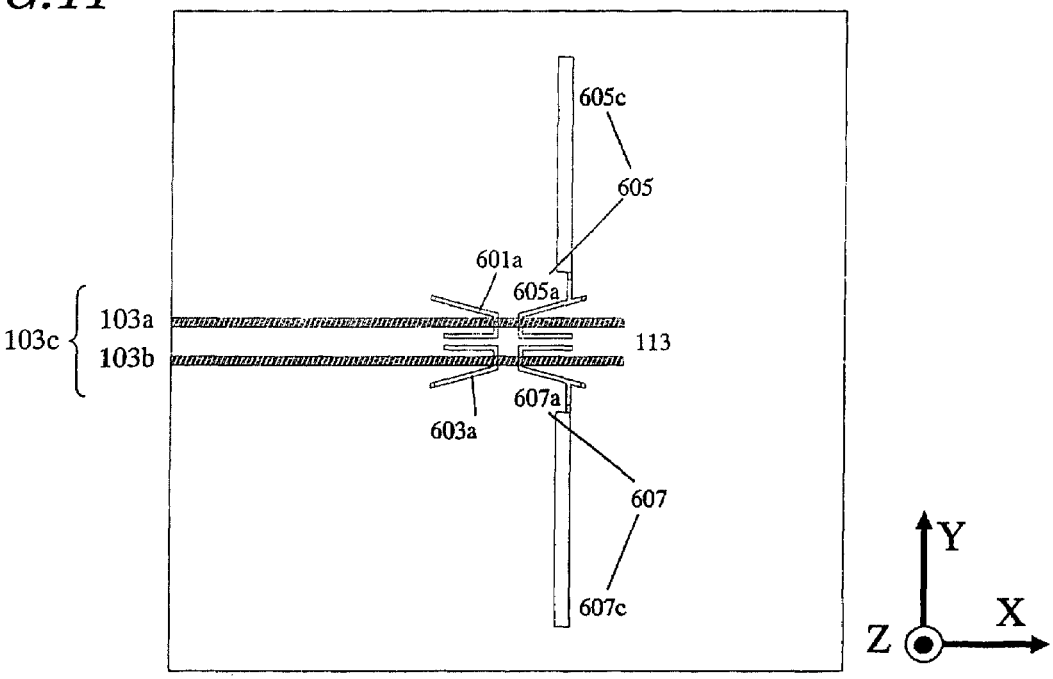
FIG. 11 is a structural diagram of a differentially-fed slot antenna according to the present invention in a second operating state.
Figure 12:
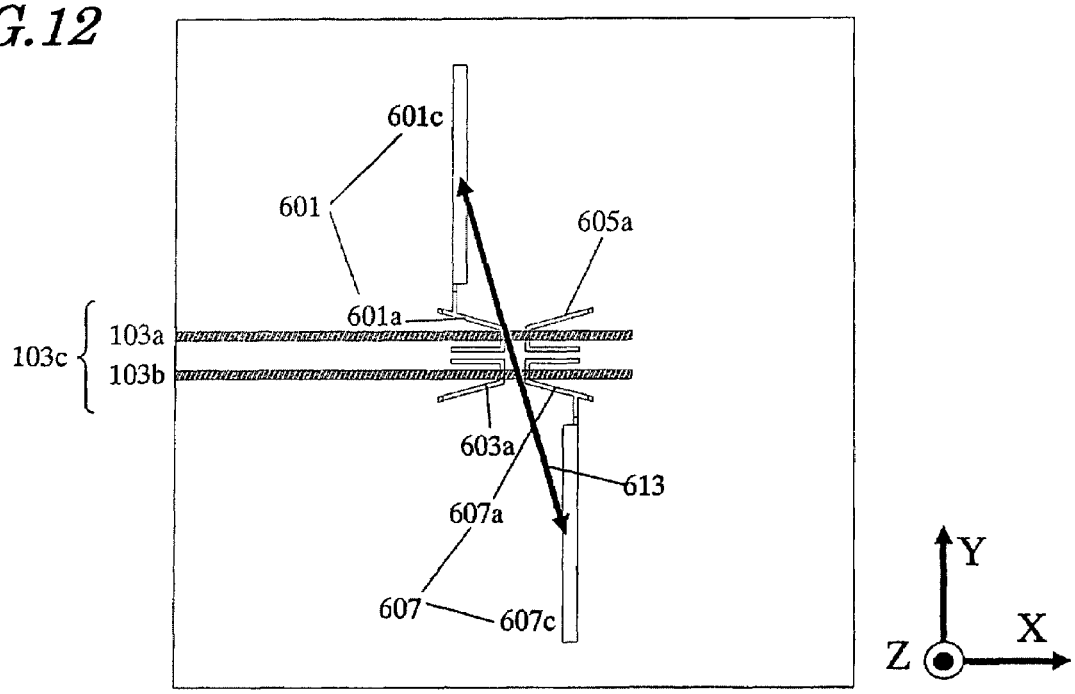
FIG. 12 is a structural diagram of a differentially-fed slot antenna according to the present invention in a second operating state.

In FIG. 10, four slot resonators 601, 603, 605, and 607 are simultaneously operated in two pairs to realize the second operating state. In FIG. 11, a pair of slot resonators 605 and 607 are operated while switching the slot resonators 601 and 603 to a non-operating state, thus realizing the second operating state. As shown in FIG. 12, even in the case where a pair of slot resonators 601 and 607 which are not placed in strictly mirror symmetrical positions are operated, the main beam direction can be oriented in a direction 613 which is parallel to the direction that connects between the center portion 601*j* with the center portion 607*j*. In this case, too, a gain suppression effect can be effectively obtained along directions which are substantially orthogonal to the main beam.

It is not only in the case where θ1 is 180° that a gain enhancement effect is expectable from Combination 2. A radiation gain enhancement according to natural principles is expectable so long as the effective phase difference θ1 between the center portions of the selective radiation portions of the slot resonators is 90° or more.

<Third Operating State: Orienting the Main Beam Direction in the ±Z Direction>

Next, as a third operating state, a method of controlling the slot resonators so that the main beam direction is oriented in the ±Z direction while also suppressing the radiation gain in the ±X direction and the ±Y direction will be described.

In the construction shown in FIG. 1, by selecting the selective radiation portions 601*b* and 603*b* and unselecting the selective radiation portions 601*c* and 603*c* of the slot resonators 601 and 603, and placing the slot resonators 605 and 607 in a non-operating state, the third operating state can be realized.

Figure 13:
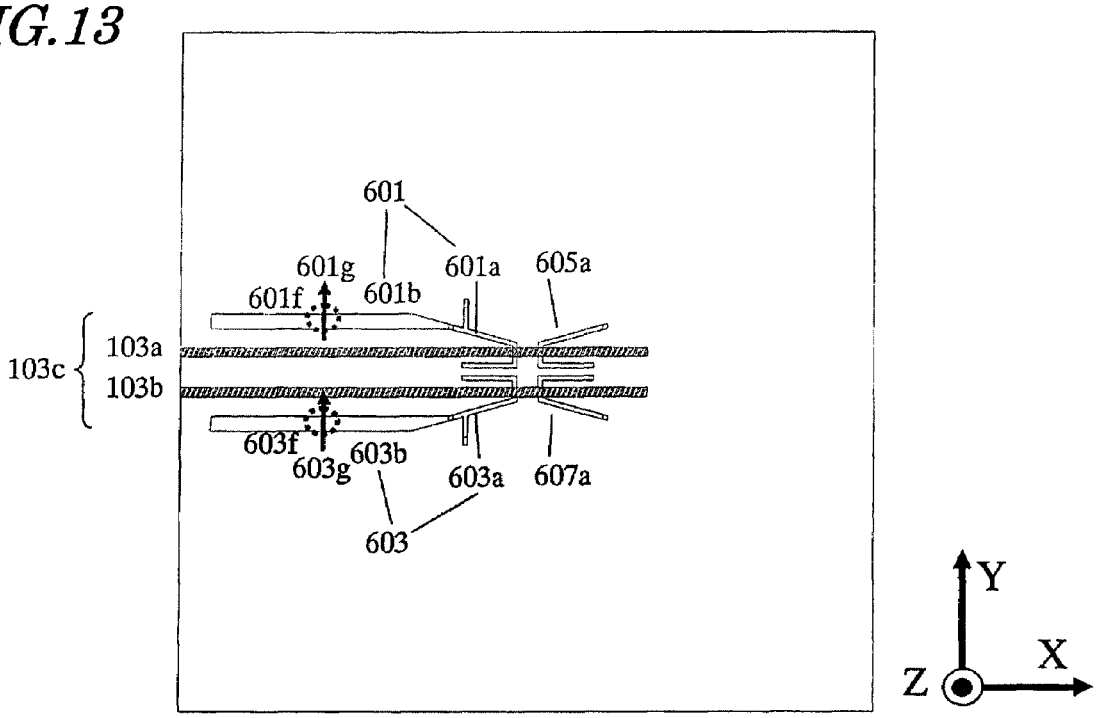
FIG. 13 is a structural diagram of a differentially-fed slot antenna according to the present invention in a third operating state.

Table 10 summarizes control states of the slot resonators in the third operating state. FIG. 13 shows a structure in which, in the third operating state, those selective radiation portions which are unselected are omitted from the structure of FIG. 1.

TABLE 10

| slot | | | high-frequency switching element | |
|---|---|---|---|---|
| resonator | operating/non-operating | construction | open | conducting |
| 601 | operating | 601a + 601b | 601d | 601e |
| 603 | operating | 603a + 603b | 603d | 603e |
| 605 | non-operating | — | | 605d |
| 607 | non-operating | | | 607d |

Hereinafter, the radiation characteristics from the antenna operating in the second operating state will be described. In the following, the radiation characteristics will be regarded as those of an array antenna whose antenna elements are field vector elements 601*g* and 603*g* occurring at respective central portions 601*f* and 603*f* of the selective radiation portions 601*b* and 603*b* of the two slot resonators.

Table 11 summarizes the relationship among θ1, θ2, and θs between the field vector elements as viewed from a point in infinity along each of the X axis, the Y axis, and the Z axis.

TABLE 11

| Combination | coordinate direction | vector element | θ1 | θ2 | θs | change in radiation intensity |
|---|---|---|---|---|---|---|
| 1 | X | 601 g 603 g | 0° | 0° | 0° | — |
| 2 | Y | | | | | |
| 3 | Z | | | | | |

As is clear from Table 11, the radiations from both field vector elements are added in every coordinate axis direction, so that no relative changes in radiation gain intensity occur. In other words, in the third operating state, radiation characteristics are realized with a doubled intensity of that of the radiation characteristics of the slot resonator 601.

Note that the radiation characteristics of the slot resonator 601 alone are the radiation characteristics of a ½ effective wavelength slot resonator described earlier as Conventional Example 1 (which is fed through a single-ended feed line) being rotated by 90° around the Z axis in the XY plane.

Figure 27A:
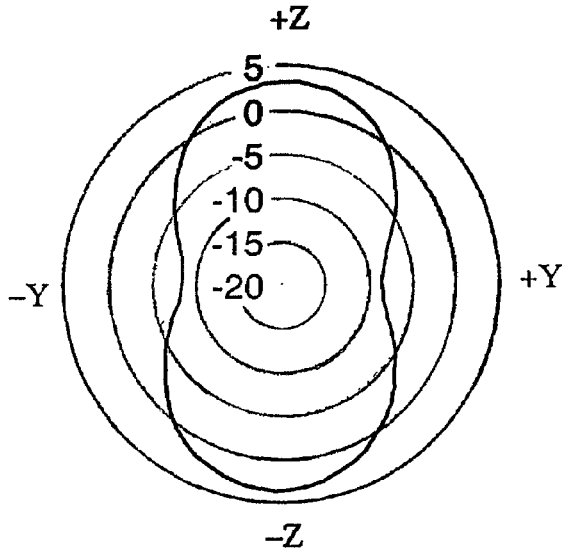
FIGS. 27A and 27B are radiation directivity characteristics diagrams of Conventional Example 1.
Figure 27B:
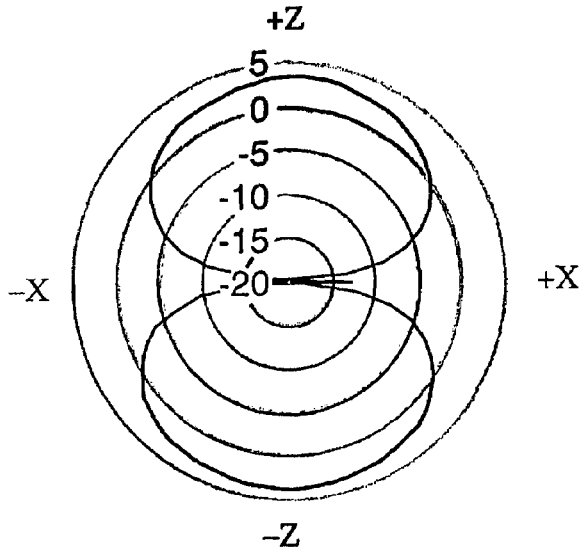
Figure 28A:
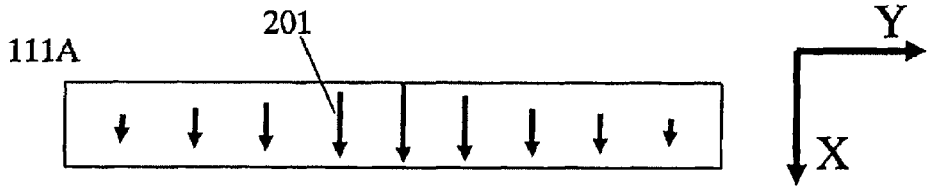
FIGS. 28A and 28B are schematic diagrams of field distributions within a ½ wavelength slot resonator.
Figure 28B:
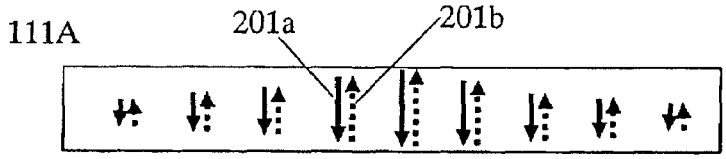
Figure 29B:
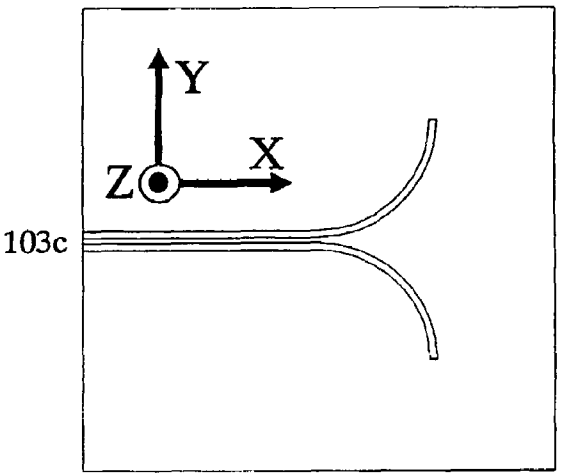
FIGS. 29A and 29B are structural diagrams of a differentially-fed strip antenna (Conventional Example 3).
Figure 29C:
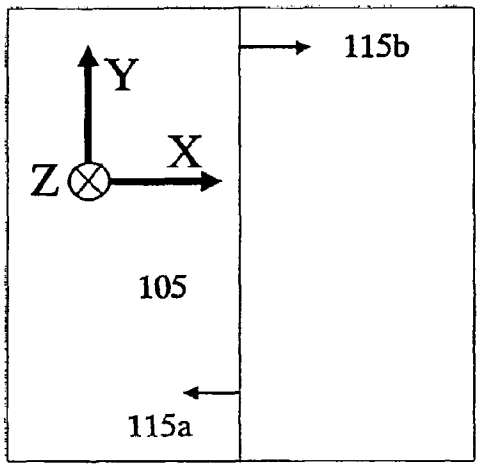
FIG. 29C is a lower schematic view.
Figure 29A:
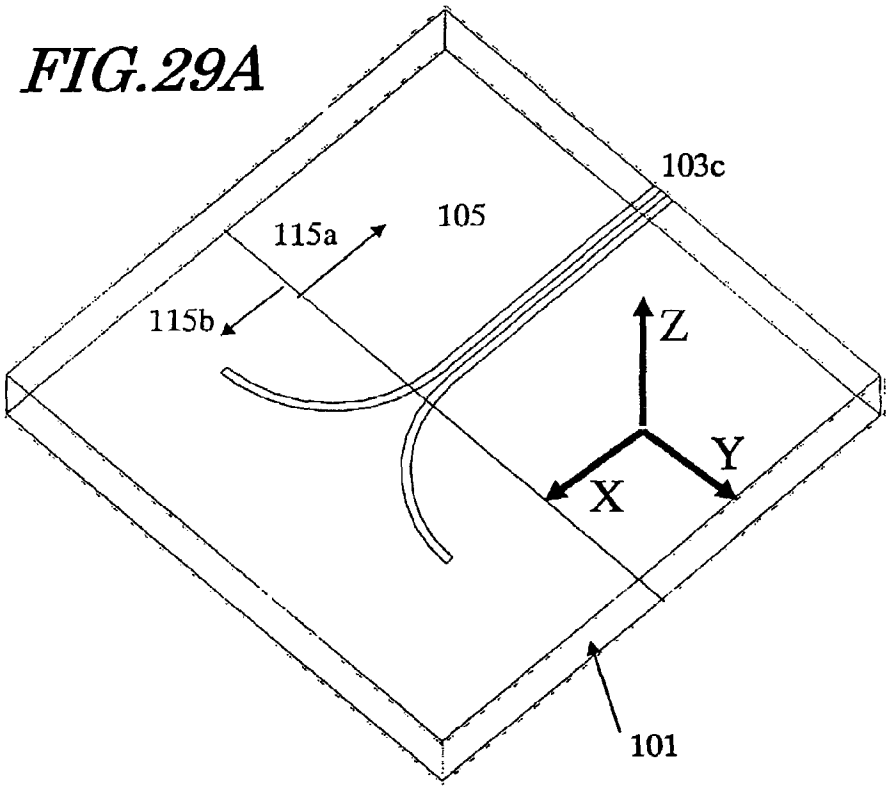
Figure 30A:
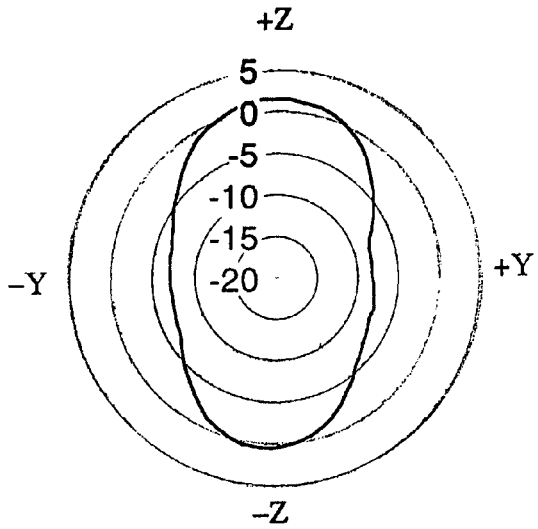
FIGS. 30A and 30B are radiation directivity characteristics diagrams of a differentially-fed strip antenna of Conventional Example 3.
Figure 30B:
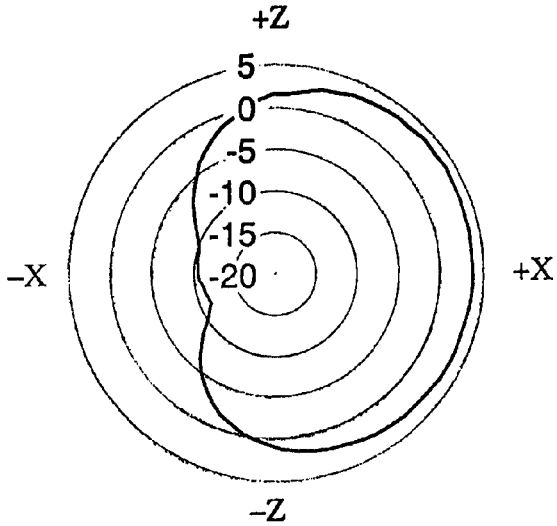

As shown in FIG. 27, Conventional Example 1 has radiation characteristics such that the main beam is oriented in the ±Z direction and a good gain suppression effect is obtained in the ±X direction, with a gain reduction (of about 10 dB with respect to the main beam) being expectable also in the ±Y direction. Therefore, the present differentially-fed slot antenna realizes radiation characteristics such that the main beam direction is oriented in the ±Z direction and null characteristics are obtained in the ±Y direction, with a gain reduction (of about 10 dB with respect to the main beam) being expectable also in the ±X direction.

Note that the minimum construction that is necessary for realizing the third operating state is a pair of slot resonators. Therefore, the third operating state can also be realized with a construction which is obtained by eliminating altogether the slot resonators 605 and 607 from the circuit construction shown in FIG. 1. In other words, in order to realize reconfigurability for enabling a switching between the second operating state and the third operating state, it is not necessary to introduce the slot resonators 605 and 607 into the construction.

Figure 14:
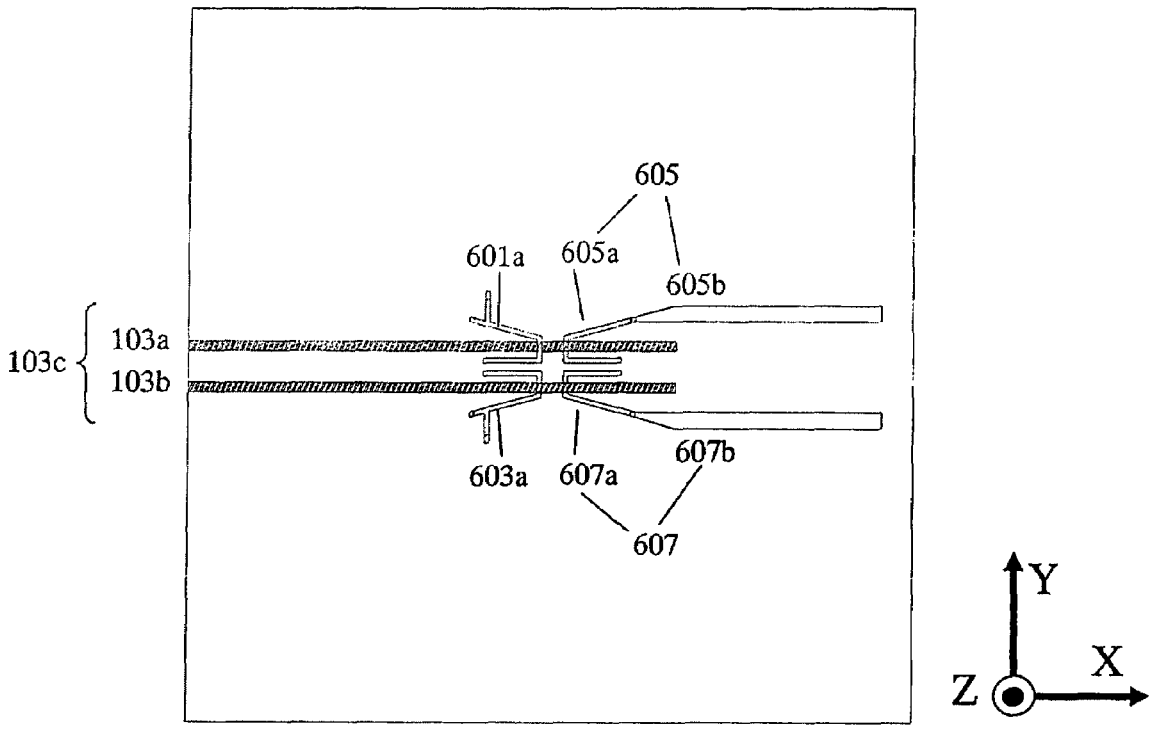
FIG. 14 is a structural diagram of a differentially-fed slot antenna according to the present invention in a third operating state.

As shown in FIG. 14, the characteristics according to the third operating state can also be realized in the case where, using the construction of FIG. 9, a pair of slot resonators 605 and 607 are operated while the slot resonators 601 and 603 are switched to a non-operating state.

Although Table 11 illustrates that θ1 is 0° in Combination 2, strictly speaking, it is impossible to set the effective phase difference between the center portions of the selective radiation portions of the slot resonators along the Y axis to 0°.

In order to realize the third operating state, it is necessary that the gain enhancement effect be suppressed along the Y axis direction. Accordingly, it is necessary to ensure that there is only a small effective phase difference between slot resonators that are disposed along the Y axis direction, in particular. Specifically, this can be attained by setting the value of θ1 defined along the Y axis direction to less than 90°.

<End Treatment for Open Sites of the Feed Line>

The differential feed line 103*c* may be left open-ended at an end point 113. By setting the feed matching length from the end point 113 to the feeding portion of each of the slot resonators 601, 603, 605, and 607 so as to be a ¼ effective wavelength with respect to the odd mode propagation characteristics in the differential line at the operating frequency, the input matching characteristics for the slot resonators can be improved.

At the end point of the differential feed line 103*c*, the first signal conductor 103*a* and the second signal conductor 103*b* may be grounded via resistors of an equal value. At the end point of the differential feed line 103*c*, the first signal conductor 103*a* and the second signal conductor 103*b* may be connected to each other via a resistor.

If a resistor(s) is introduced at the end point of the differential feed line, some of the input power to the antenna circuit will be consumed in the introduced resistor(s), and thus a decrease in radiation efficiency will result. However, such a resistor(s) will allow the input matching condition for the slot resonators to be relaxed, thus making it possible to reduce the value of feed matching length.

<Implementability of High-Frequency Switching Elements>

As a method for implementing the high-frequency switching elements 601*d*, 601*e*, 603*d*, 603*e*, 605*d*, 605*e*, 607*d*, and 607*e*, diode switches, high-frequency switches, MEMS switches or the like are available. For example, by using commercially-available diode switches, good switching characteristics with a series resistance value of 5Ω in a conducting state and a parasitic series capacitance value of about 0.05 pF in an open state can be easily obtained in a frequency band of 20 GHz or less, for example.

As described above, by adopting the structure of the present invention, there is provided a variable antenna which enables: directing the main beam in a direction which cannot be achieved with a conventional slot antenna or differentially-fed antenna; switching the main beam direction; and suppressing the radiation gain mainly in directions which are orthogonal to the main beam direction.

EXAMPLE

An Example of the antenna of the present invention was produced as follows. By using copper lines, a wiring layer having a thickness of 25 microns was provided on each of front and rear faces of a dielectric substrate having a dielectric constant of 4.3 and a thickness of 0.5 mm. Thereafter, a partial region was completely removed along the thickness direction of the wiring lines by wet etching, thus forming a signal conductor pattern on the front face and a ground conductor pattern on the rear face. On the front face, a differential feed line having a line width W of 0.6 mm was formed, with a gap width G of 0.5 mm between the wiring lines.

Figure 15B:
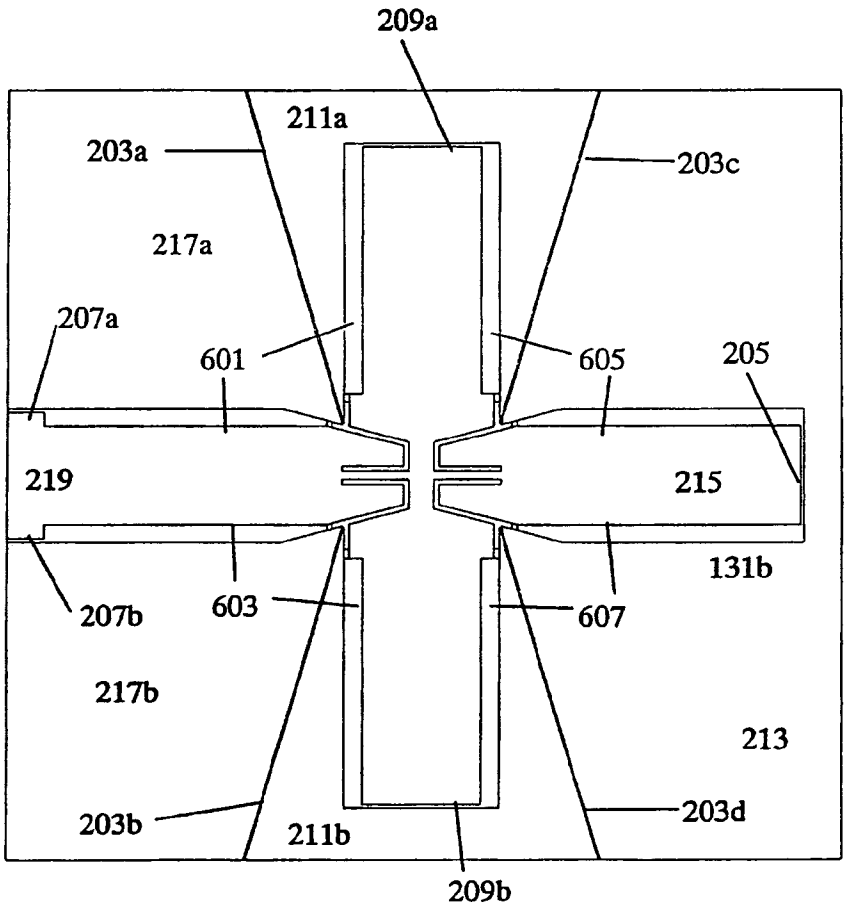
FIGS. 15A and 15B are schematic structural diagrams of an Example of the present invention.
Figure 15A:
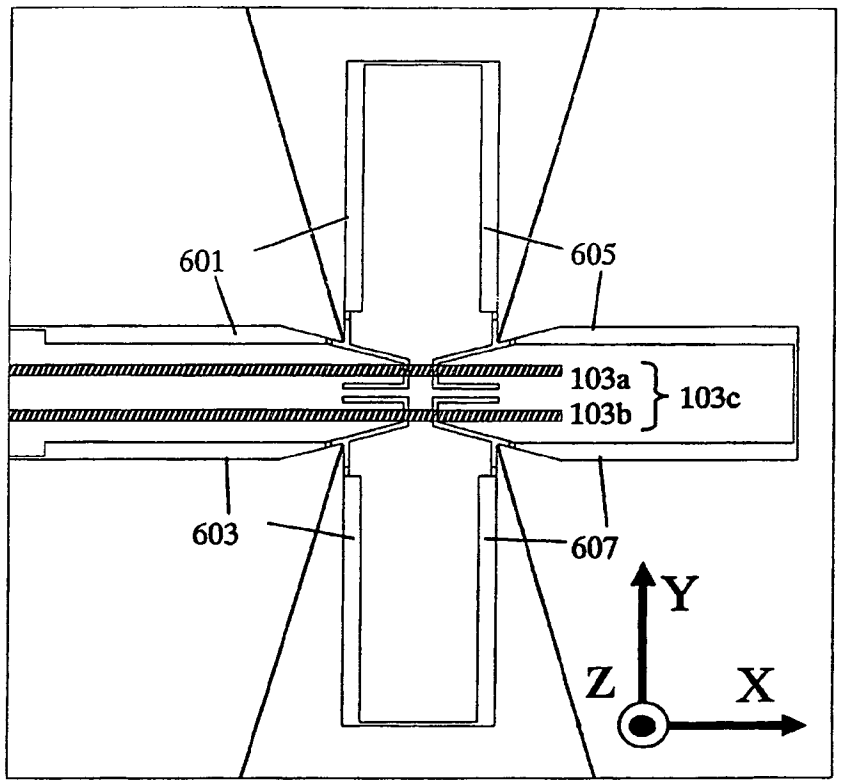

FIG. 15A shows a see-through pattern diagram of the differentially-fed slot antenna of the Example as viewed from the lower face; and FIG. 15B shows a pattern diagram on the rear face. In the Example, three kinds of slot patterns were formed: a portion having a width of 0.1 mm, a portion having a width of 0.3 mm, and a portion having a width of 1 mm. In the structure, four slot resonators 601, 603, 605, and 607 were formed. The feeding portions of the slot resonators 601 and 605 were coupled only to the first signal conductor 103*a*, whereas the feeding portions of the slot resonators 603 and 607 were coupled only to the second signal conductor 103*b*. Slot resonators 601 and 603 were formed in a mirror symmetrical manner, and so were slot resonators 605 and 607.

A coordinate system similar to that of Conventional Example is also used in the Example. The slot resonators 601 and 605 (and the slot resonators 603 and 607) were placed in mirror symmetrical positions with respect to a plane of symmetry which is defined by the YZ plane (X=0). The differential feed line 103*c* was open-ended at X=+8.

As shown in FIG. 15B, in the Example, a plurality of thin slots for bias separation were formed in addition to the slot resonators, thus finely splitting the conductor pattern of the ground conductor regions. A ground conductor region 215 exhibited the same DC potential as that of a ground conductor region 219 lying immediately under the input point for the differential feed line 103*c*. In other words, the conductor was not split between the ground conductor region 215 and the ground conductor region 219.

However, the ground conductor regions 215 and 219 were DC-isolated from the ground conductor regions 211*a*, 211*b*, 213, 217*a*, and 217*b*. Specifically, slots 203*a* to 203*d*, 205, 207*a*, 207*b*, 209*a*, and 209*b* for bias separation and the four slot resonators 601, 603, 605, and 607 were always inserted between conductor regions, thus providing isolation between these ground conductor regions.

The slots for bias separation had a uniform slot width of 0.1 mm. However, in the Example, these ground conductor regions need to function so as to be conducting in high-frequency terms. Therefore, as shown in FIG. 16A, twenty chip capacitors 609 each having a capacitance value of 3 pF were provided at positions astride the slots 203*a* to 203*d*, 205,

207*a*, 207*b*, 209*a*, and 209*b* for bias separation, thus allowing the ground conductor regions to be mutually conducting in high-frequency terms.

Figure 16B:
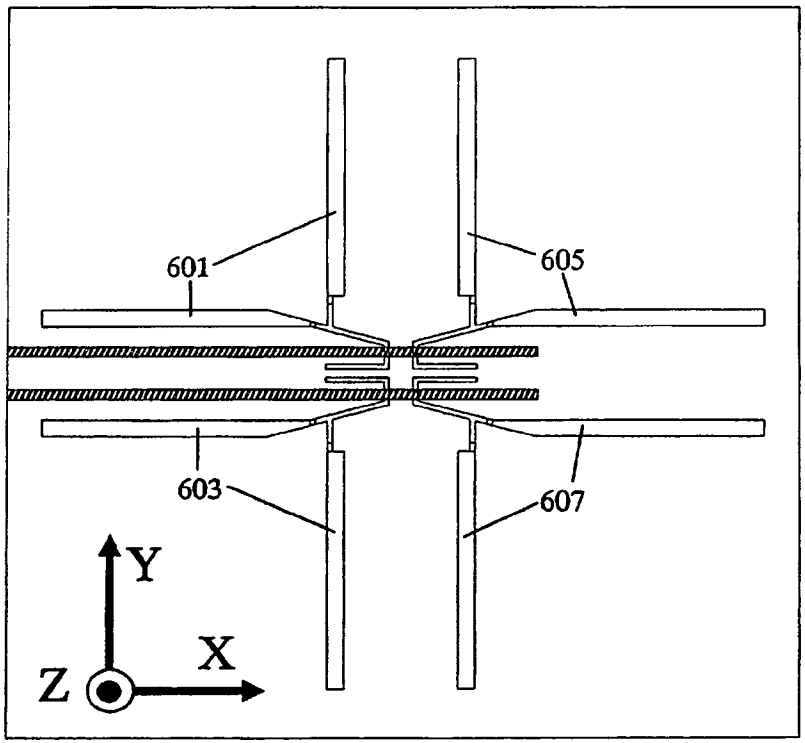
FIGS. 16A and 16B are schematic structural diagrams of an Example of the present invention.
Figure 16A:
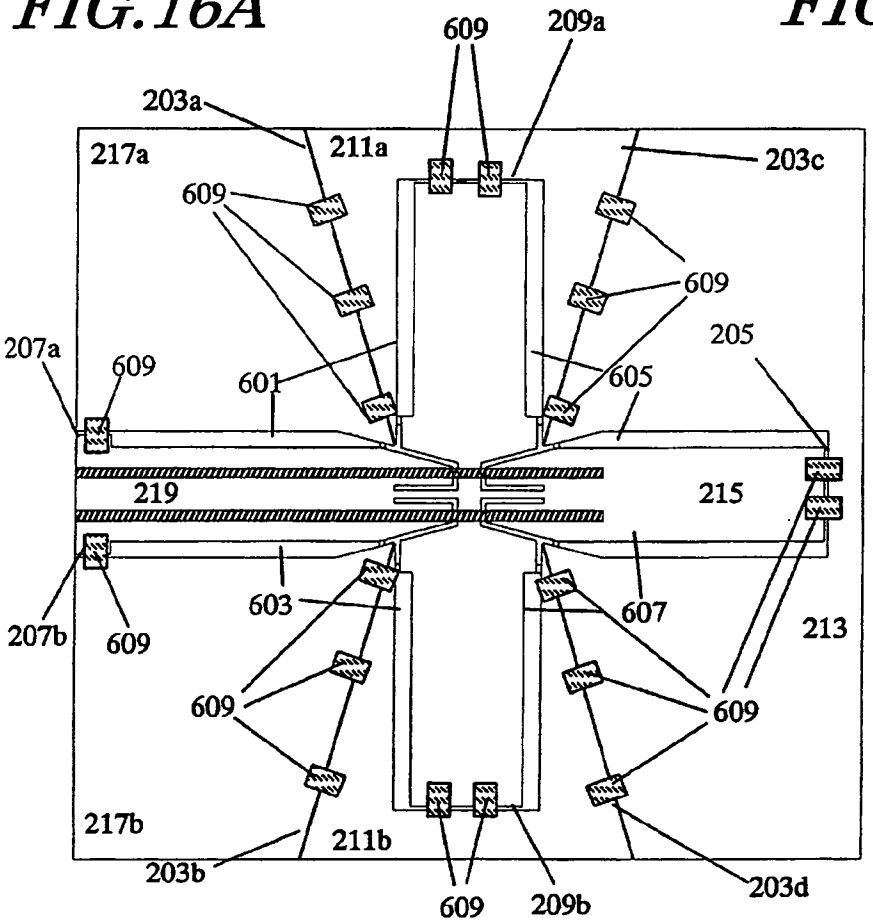

After mounting of the chip capacitors, the slot pattern that was realized in high-frequency terms on the substrate rear face consisted only of the four slot resonators 601, 603, 605, and 607, as shown in FIG. 16B.

Figure 17:
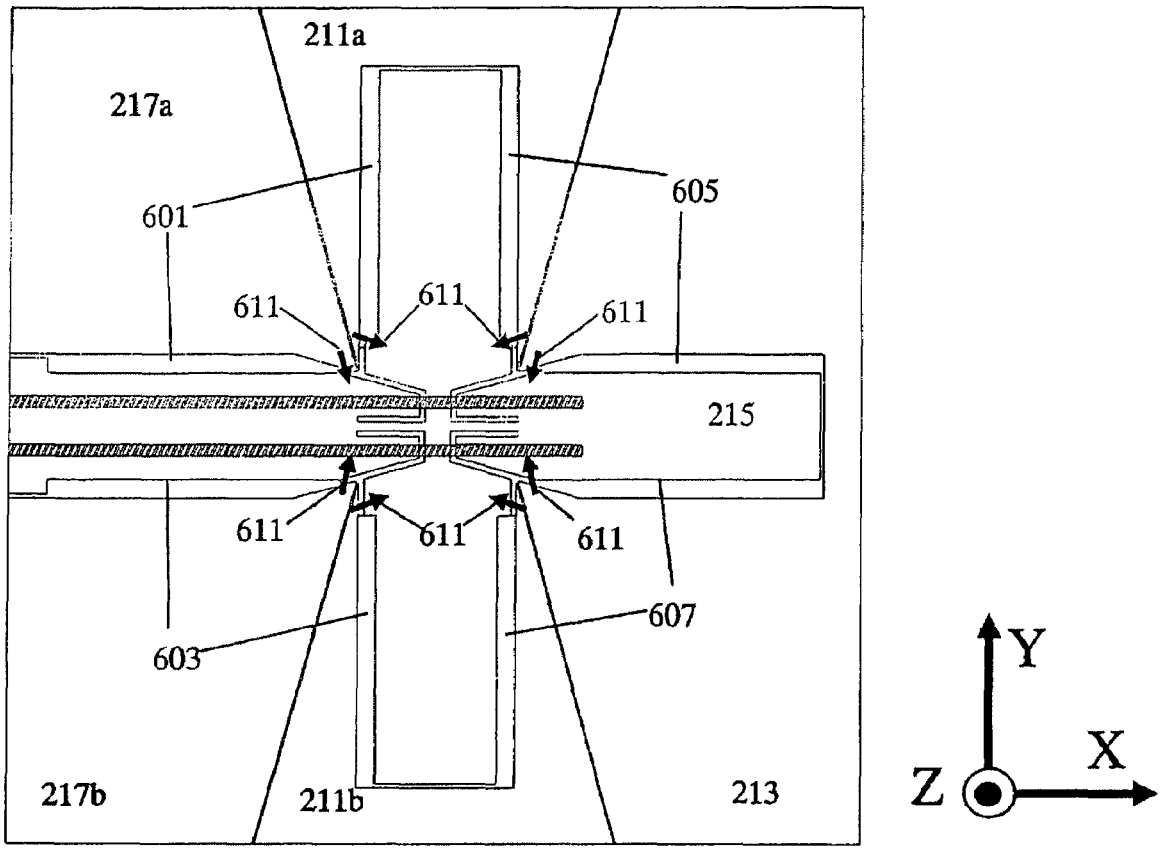
FIG. 17 is a schematic structural diagram showing positioning of diode switches in an Example of the present invention.

Next, diode switches 611 were mounted at eight positions shown by arrows in FIG. 17. Each diode switch was mounted so as to straddle the corresponding slot resonator in the width direction, thus connecting between the ground conductor regions on both sides. Each diode switch used was a GaAs PIN diode having a length of 700 microns and a width of 380 microns. At 5.25 GHz, when a voltage of a positive sign was applied, each diode switch functioned as a DC resistance of 4 Ω in high-frequency terms, with an insertion loss of 0.4 dB; and when a negative voltage was applied or no voltage was applied, each diode switch functioned as a DC capacitance of 30 fF in high-frequency terms, with an insertion loss of 20 dB.

In the Example, the DC voltage applied in the ground conductor region 215 was always zero volts. Therefore, by applying control voltages in the external ground conductor regions 211*a*, 211*b*, 213, 217*a*, and 217*b* via resistances, a manner of control was achieved which realized an RF structure reconfigurability function of the four slot resonators 601, 603, 605, and 607 according to the Example.

<Supporting the First Operating State (±X Direction)>

Figure 18B:
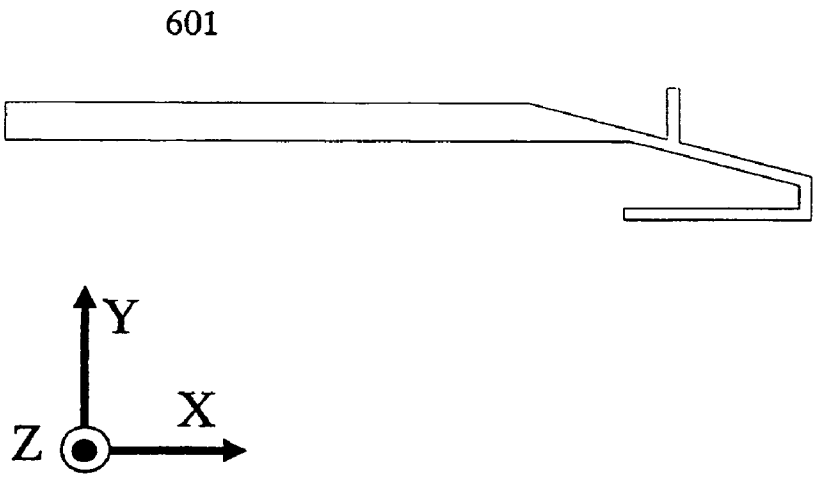
FIGS. 18A and 18B are schematic structural diagrams which are realized in high-frequency terms in a first operating state of an Example of the present invention.
Figure 18A:
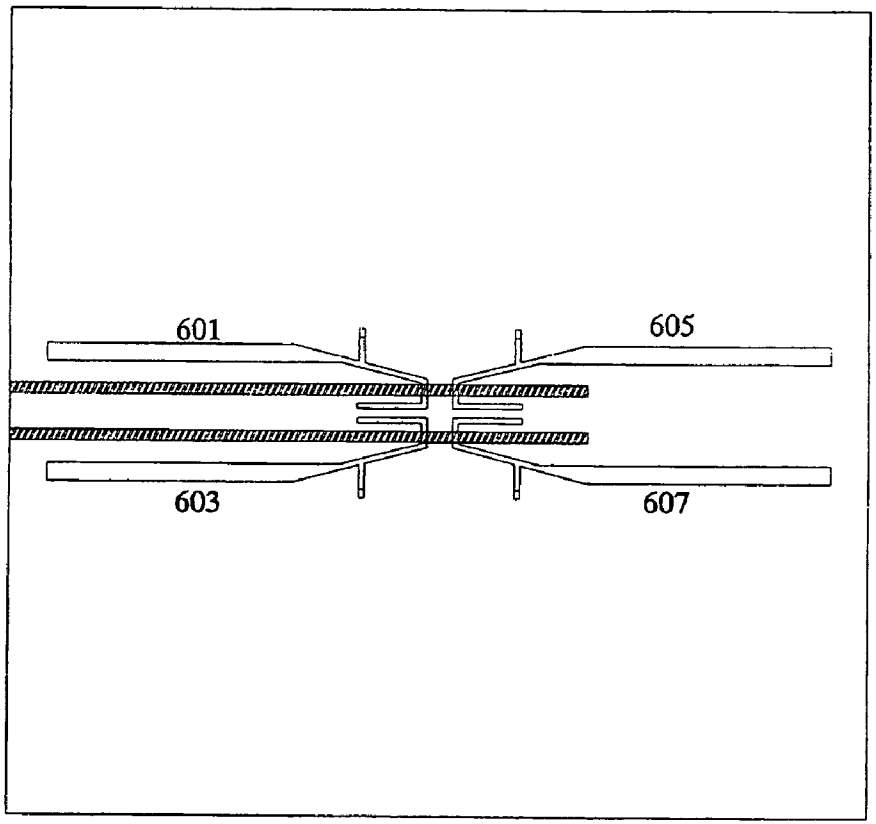

To realize the first operating state, a positive voltage was applied in the ground conductor regions 211*a* and 211*b* and a negative voltage was applied in the ground conductor regions 213, 217*a*, and 217*b*, thus realizing a slot structure as shown in FIG. 18A. That is, in the first operating state, the four slot resonators 601, 603, 605, and 607 existed along the X axis direction. Since all of the slot resonators have an identical shape, only the slot resonator 601 among them is shown enlarged in FIG. 18B.

Each slot had a slot width of 0.3 mm at the feeding portion, which gradually increased from 0.3 mm and finally reached 1 mm at the radiation portion. The radiation portion had a length of 16 mm. In the first operating state, return characteristics were obtained such that, at 5.25 GHz, there was a return loss of −18.5 dB with respect to a differential signal.

FIG. 19A shows radiation directivity characteristics in the YZ plane; FIG. 19B shows those in the XZ plane; and FIG. 19C shows those in the XY plane.

As is clear from the readings on the XZ plane and the XY plane, in the first operating state, the main beam direction was in the ±X direction. The radiation gain was 0.5 dBi, with substantially the same value being obtained in the plus X direction and the minus X direction. In the ±Z direction, null characteristics were obtained, with a suppression ratio of 22 dB with respect to the main beam. Also in the ±Y direction, a good suppression ratio of 7 dB with respect to the main beam was obtained.

Figure 20:
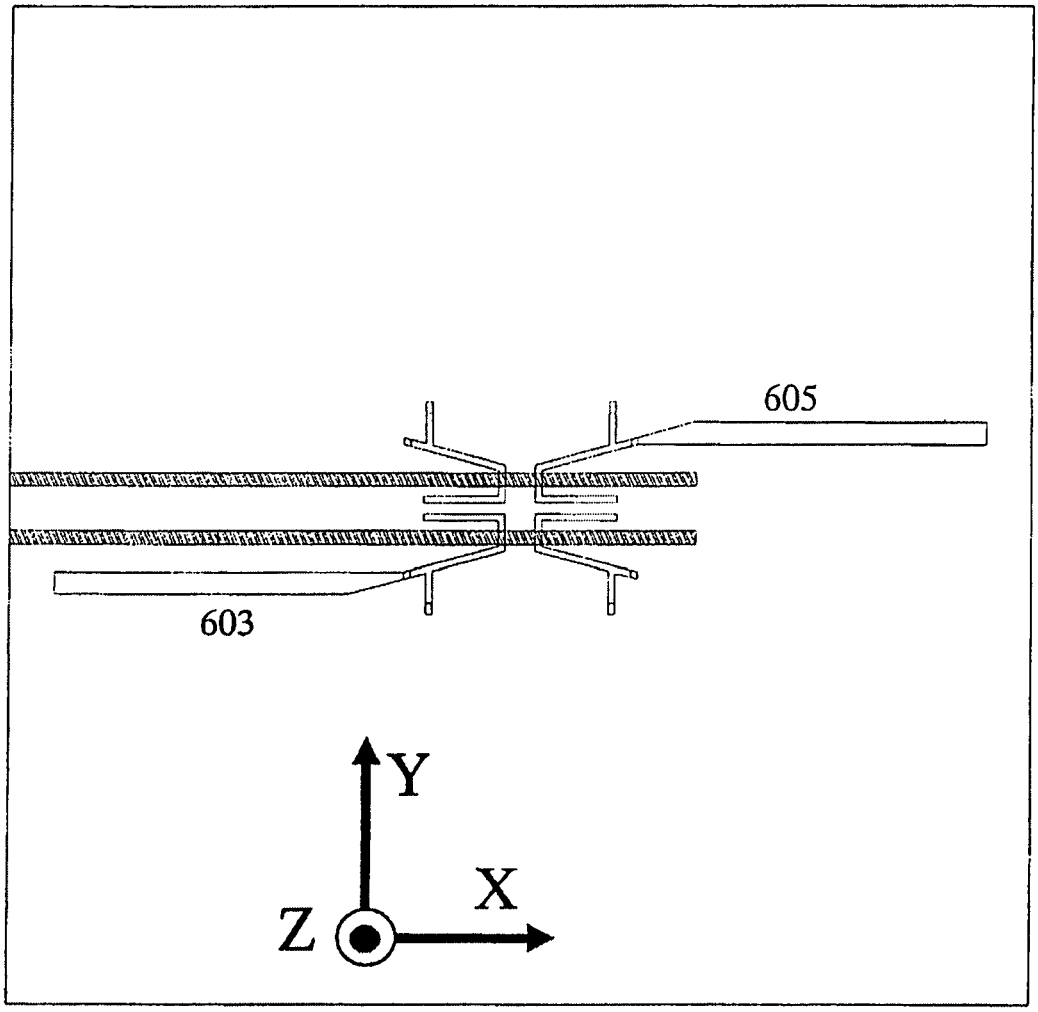
FIG. 20 is a schematic structural diagram which is realized in high-frequency terms in an Example of the present invention in a first operating state.

Also in a state where the slot structure for bias separation was changed to allow only the slot resonators 603 and 605 to operate, so that a slot structure as shown in FIG. 20 was realized in high-frequency terms, a gain reduction or suppression effect was obtained in a direction which was tilted with respect to the main beam direction by about 10° toward the Y axis direction from the X axis direction, this direction being orthogonal to the main beam, as shown in FIGS. 21A to 21C.

<Supporting the Second Operating State (±Y Direction)>

Figure 22B:
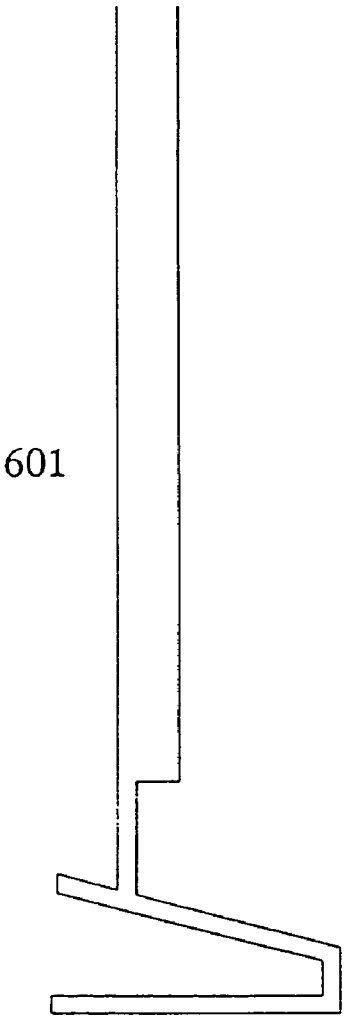
FIGS. 22A and 22B are schematic structural diagrams which are realized in high-frequency terms in a second operating state of an Example of the present invention.
Figure 22A:
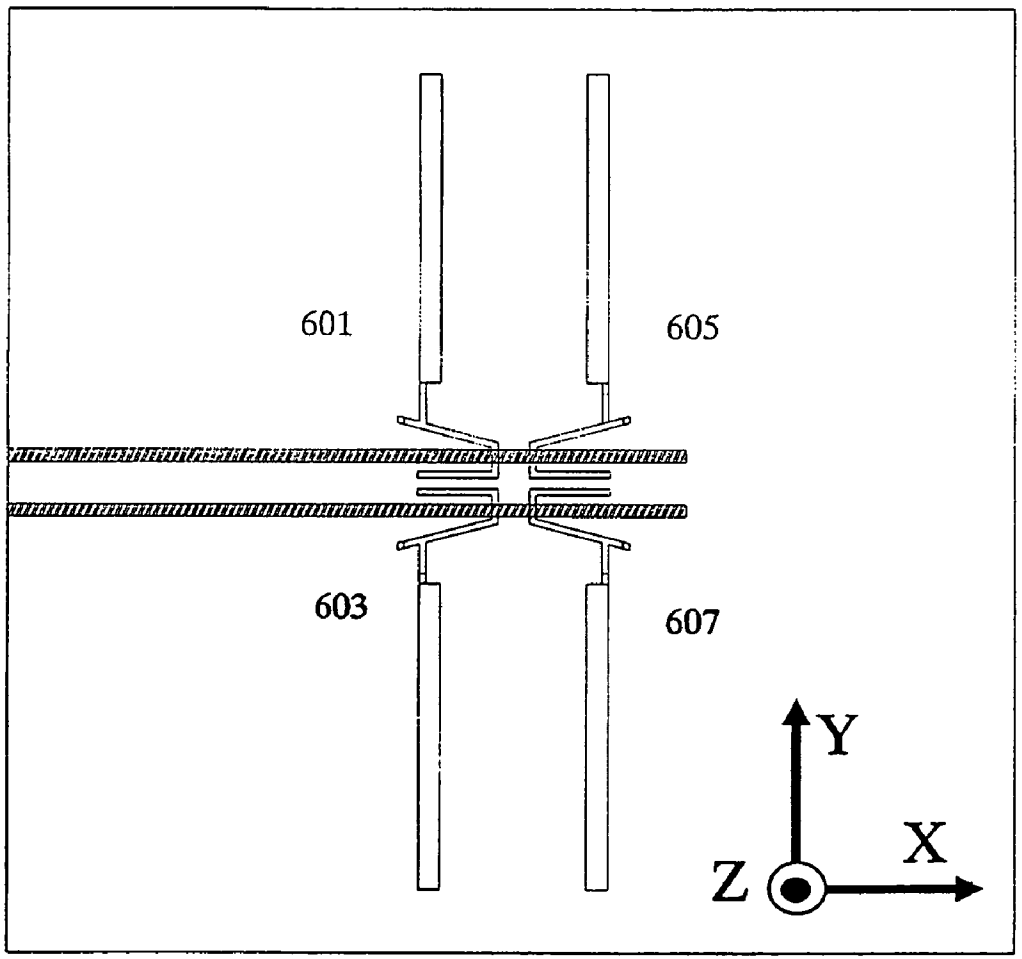

FIG. 22A shows a slot structure which is formed on the rear face of the dielectric substrate in high-frequency terms when, in the second operating state, a positive voltage is applied in the ground conductor regions 213, 217*a*, and 217*b* and a negative voltage is applied in the ground conductor regions 211*a* and 211*b*.

In the second operating state, four slot resonators existed along the Y axis direction. The slot resonators were rotation symmetrical with respect to the origin (X=Y=0), one of them being shown enlarged in FIG. 22B. Each slot had a slot width of 0.3 mm at the feeding portion and 1 mm at the radiation portion, the radiation portion having a length of 14.8 mm.

In the second operating state, good return characteristics were obtained such that, at 5.25 GHz, there was a return loss of −18 dB with respect to a differential signal.

Figure 23C:
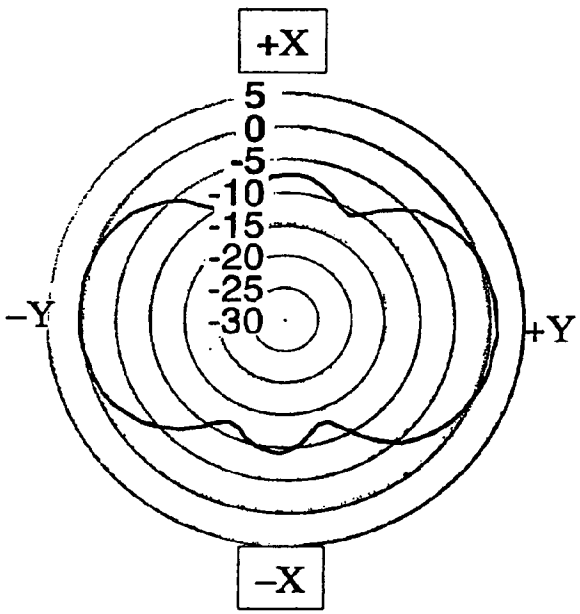
FIGS. 23A, 23B, and 23C are radiation directivity characteristics diagrams of an Example of the present invention in a second operating state at 5.25 GHz.
Figure 23B:
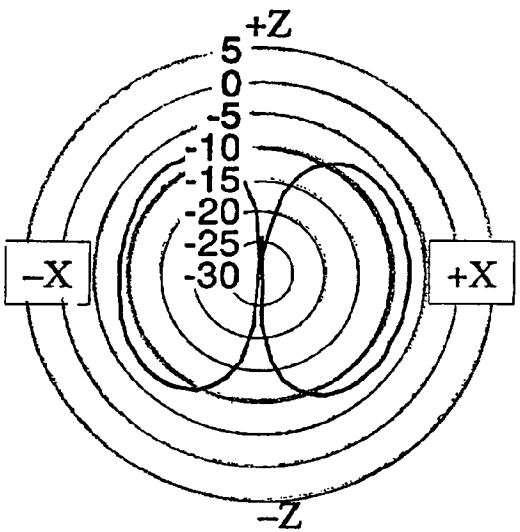
Figure 23A:
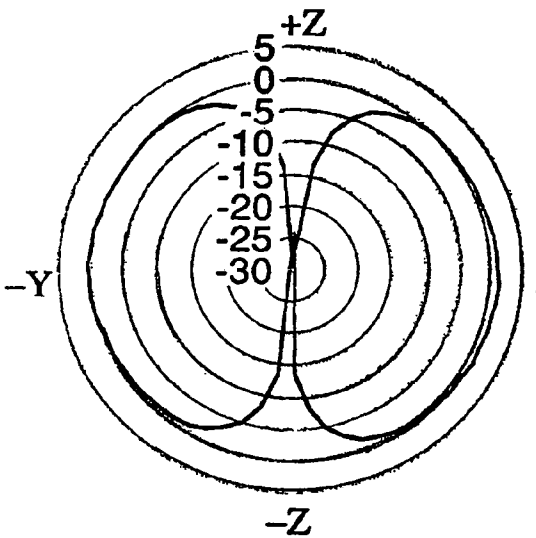

FIG. 23A shows radiation directivity characteristics in the YZ plane; FIG. 23B shows those in the XZ plane; and FIG. 23C shows those in the XY plane.

As is clear from the readings on the YZ plane and the XY plane, in the second operating state, radiation directivity characteristics were realized such that the main beam direction was in ±Y direction. The radiation gain was a little less than 1 dBi, with substantially the same value being obtained in the ±Y direction and the minus Y direction. In the ±Z direction, null characteristics were obtained, with a suppression ratio of 25 dB with respect to the main beam. Also along the X axis direction, good suppression ratios with respect to the main beam were obtained, i.e., 8 dB in the plus X direction and 10 dB in the minus X direction.

<Supporting the Third Operating State (±Z Direction)>

Figure 24:
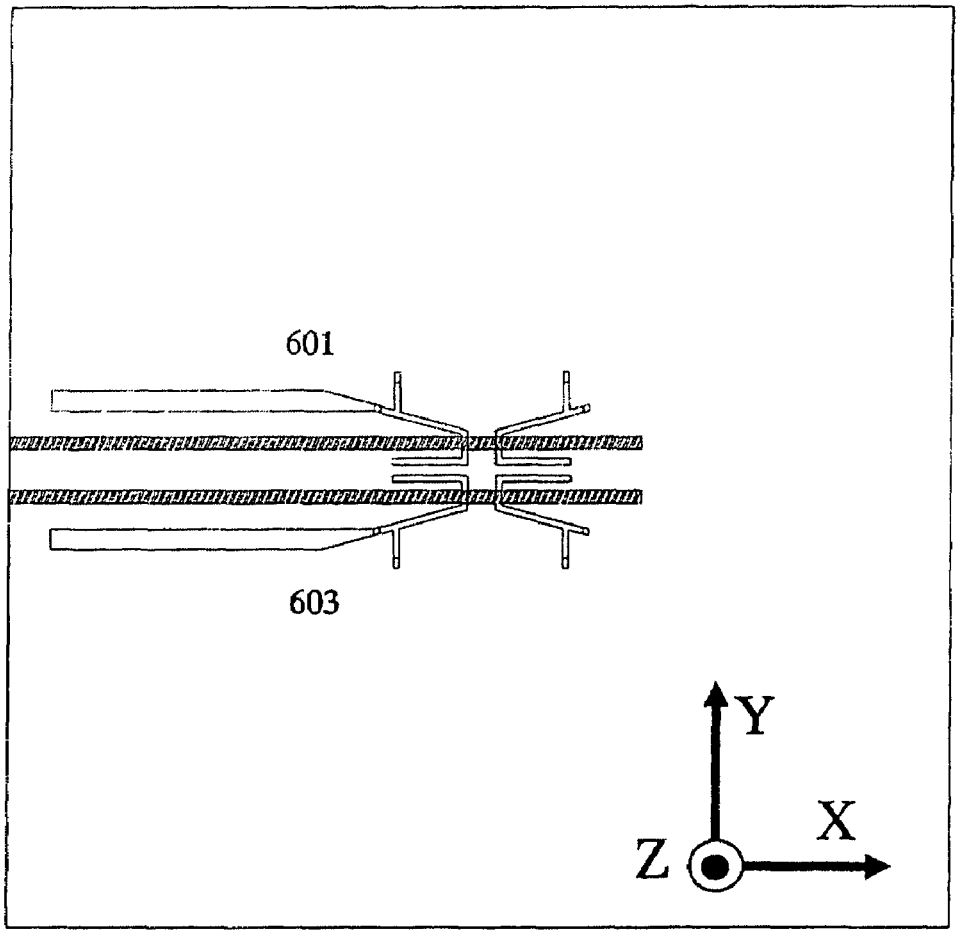
FIG. 24 is a schematic structural diagram which is realized in high-frequency terms in an Example of the present invention in a third operating state.

Next, to realize the third operating state, a positive voltage was applied in the ground conductor regions 211*a*, 211*b*, and 213 and a negative voltage was applied in the ground conductor regions 217*a* and 217*b*, thus realizing a slot structure as shown in FIG. 24. That is, in the third operating state, the slot resonators 605 and 607 were unselected, and the two slot resonators 601 and 603 existed along the X axis to operate. In the third operating state, return characteristics were obtained such that, at 5.25 GHz, there was a return loss of −6.5 dB with respect to the differential signal.

Figure 25A:
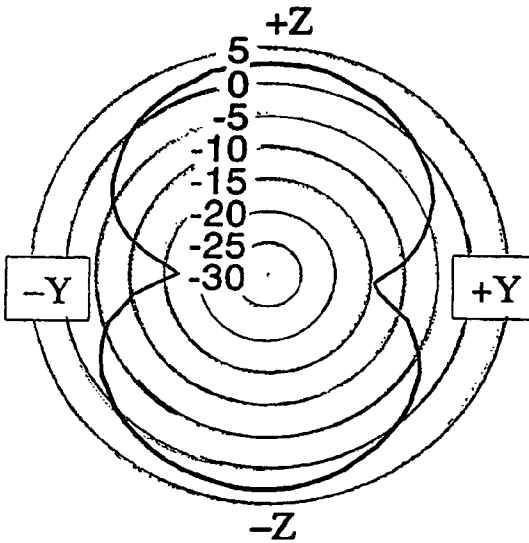
FIGS. 25A, 25B, and 25C are radiation directivity characteristics diagrams of an Example of the present invention in a first operating state at 5.25 GHz.
Figure 25B:
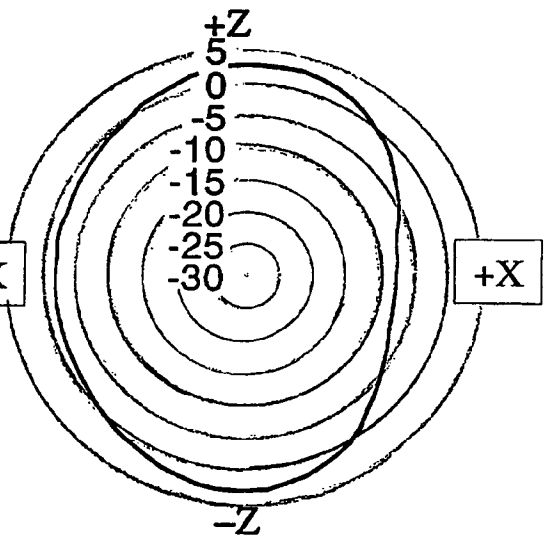
Figure 25C:
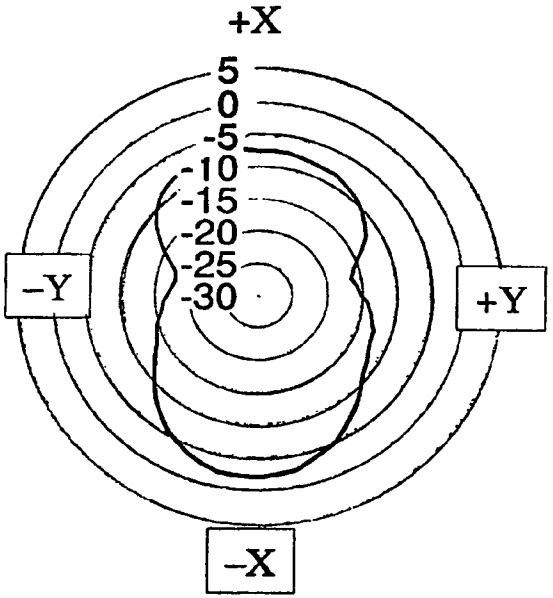
Figure 26B:
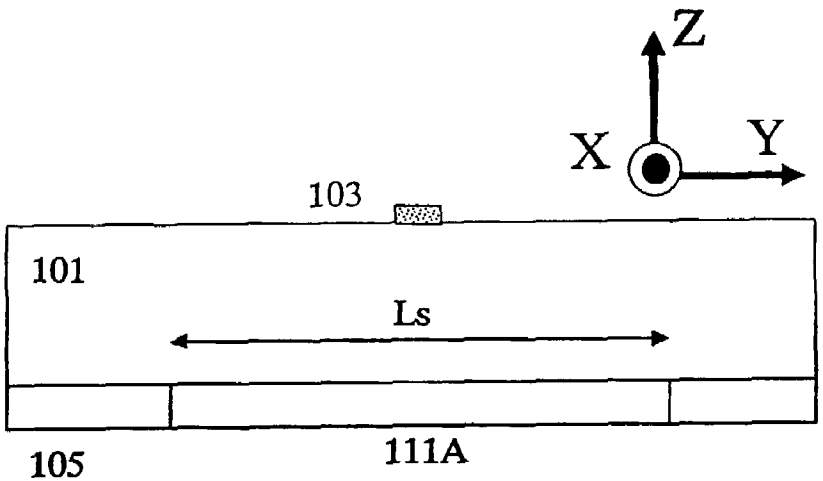
FIGS. 26A and 26B are structural diagrams of a single-ended line feed ½ wavelength slot antenna (Conventional Example 1).
Figure 26A:
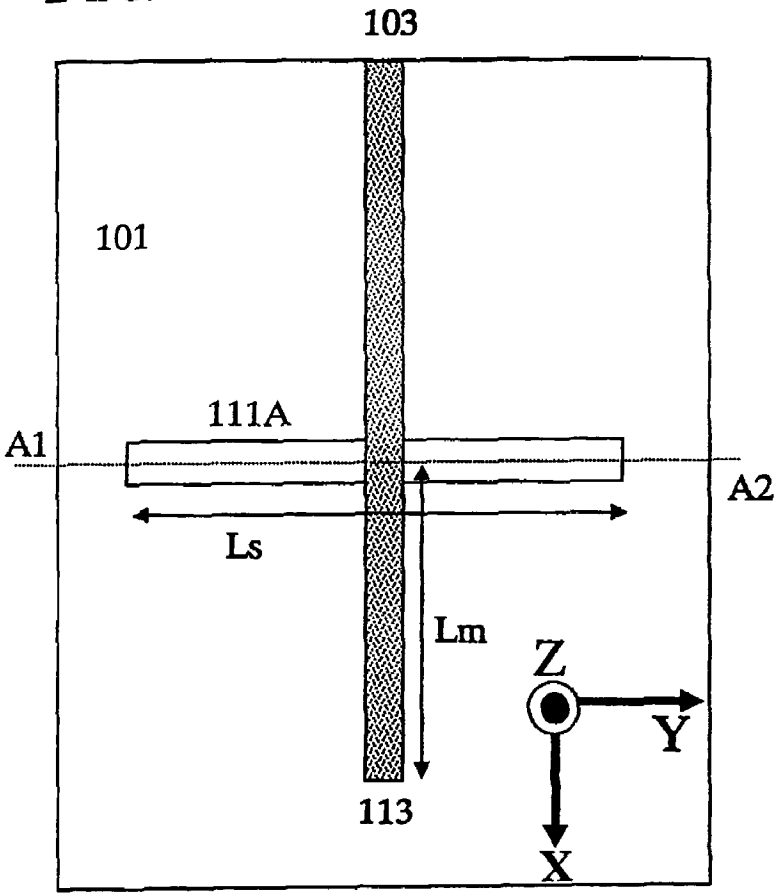

FIG. 25A shows radiation directivity characteristics in the YZ plane; FIG. 25B shows those in the XZ plane; and FIG. 25C shows those in the XY plane.

As is clear from the readings on the YZ plane and the XZ plane, in the third operating state, the main beam direction was in the ±Z direction. The radiation gain was 2.8 dBi, with substantially the same value being obtained in the +Z direction and the minus Z direction. In the ±Y direction, null characteristics were obtained, with a suppression ratio of 16 dB with respect to the main beam. Also along the X axis direction, a radiation gain reduction effect was obtained with respect to the main beam, i.e., 10.5 dB in the +X direction, and 5 dB in the minus X direction, in which the suppression ratio is somewhat deteriorated due to asymmetry of the slot structure.

The differentially-fed slot antenna according to the present invention is able to perform efficient radiations in various directions, including directions which were difficult to realize in conventional differentially-fed antennas.

Not only is it possible to realize a variable-directivity antenna that encompasses all solid angles based on a broad range of angles in which the main beam direction is switchable, but it is also possible, according to natural principles, to suppress directivity gains in directions which are orthogonal to the main beam direction. Therefore, it is possible to realize high-speed communications in indoor environments with profuse multipaths, in particular.

The present invention is not only applicable to a broad range of purposes pertaining to the field of communications, but can also be used in various fields employing wireless technology, e.g., wireless power transmission and ID tags.

The present invention is summarized below.

The present invention is directed to a differentially-fed variable slot antenna, including:

a dielectric substrate (101);

a ground conductor surface (105) provided on a rear face of the dielectric substrate (101);

a differential feed line (103*c*) disposed on a front face of the dielectric substrate (101), the differential feed line being composed of two mirror symmetrical signal conductors (103*a*, 103*b*);

a first slot resonator (601, 605) formed on the ground conductor surface (105); and a second slot resonator (603, 607) formed on the ground conductor surface (105).

A portion of the first slot resonator (601, 605) intersects one (103*a*) of the two mirror symmetrical signal conductors (103*a*, 103*b*) but does not intersect the other signal conductor (103*b*).

A portion of the second slot resonator (603, 607) does not intersect the one signal conductor (103*a*) among the two mirror symmetrical signal conductors (103*a*, 103*b*) but intersects the other signal conductor (103*b*).

A slot length of the first slot resonator (601, 605) corresponds to a ½ effective wavelength at an operating frequency.

A slot length of the second slot resonator (603, 607) corresponds to the ½ effective wavelength at the operating frequency.

The two mirror symmetrical signal conductors (103*a*, 103*b*) are fed out-of-phase.

At least one of the first slot resonator and the second slot resonator (601, 603, 605, 607) has at least one of an RF structure reconfigurability function and an operation status switching function, thus realizing a radiation characteristics reconfigurable effect resulting into at least two states.

The first and second slot resonators (601, 603, 605, 607) each comprise a series connection structure in which a feeding portion (601*a*, 603*a*, 605*a*, 607*a*) partly intersecting the signal conductor (103*a*, 103*b*) is connected in series to a selective radiation portion (601*b*, 601*c*, 603*a*, 603*c*, 605*a*, 607*a*) not intersecting the signal conductor (103*a*, 103*b*).

In the at least one of the first and second slot resonators (601, 603, 605, 607) having the at least one function, a selective conduction path (601*d*, 601*e*) for controlling connection between the feeding portion (601*a*, 603*a*, 605*a*, 607*a*) and the selective radiation portion (601*b*, 601*c*, 603*a*, 603*c*, 605*a*, 607*a*) is inserted between the feeding portion (601*a*, 603*a*, 605*a*, 607*a*) and the selective radiation portion (601*b*, 601*c*, 603*a*, 603*c*, 605*a*, 607*a*).

In the at least one of the first and second slot resonators (601, 603, 605, 607) having the RF structure reconfigurability function, a plurality of said selective radiation portions (601*b*, 601*c*, 603*a*, 603*c*, 605*a*, 607*a*) are connected to the feeding portion (601*a*, 603*a*, 605*a*, 607*a*) each in series connection, and the selective conduction paths (601*d*, 601*e*) are controlled so that only one selective radiation portion (601*b*, 601*c*, 603*a*, 603*c*, 605*a*, 607*a*) among the plurality of selective radiation portions (601*b*, 601*c*, 603*a*, 603*c*, 605*a*, 607*a*) is connected to the feeding portion (601*a*, 603*a*, 605*a*, 607*a*) in an operating state.

In the at least one of the first and second slot resonators (601, 603, 605, 607) having the operation status switching function, the selective conduction path (601*d*, 601*e*) is controlled so that connection between the feeding portion (601*a*, 603*a*, 605*a*, 607*a*) and the selective radiation portion (601*b*, 601*c*, 603*a*, 603*c*, 605*a*, 607*a*) is terminated in a non-operating state.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A differentially-fed variable slot antenna comprising:

a dielectric substrate;

a ground conductor surface provided on a rear face of the dielectric substrate;

a differential feed line disposed on a front face of the dielectric substrate, the differential feed line being composed of two mirror symmetrical signal conductors;

a first slot resonator formed on the ground conductor surface; and a second slot resonator formed on the ground conductor surface, wherein, a portion of the first slot resonator intersects one of the two mirror symmetrical signal conductors but does not intersect the other signal conductor;

a portion of the second slot resonator does not intersect the one signal conductor among the two mirror symmetrical signal conductors but intersects the other signal conductor;

a slot length of the first slot resonator corresponds to a ½ effective wavelength at an operating frequency;

a slot length of the second slot resonator corresponds to the ½ effective wavelength at the operating frequency;

the two mirror symmetrical signal conductors are fed out-of-phase;

at least one of the first slot resonator and the second slot resonator has at least one function wherein the at least one function comprises an RF structure reconfigurability function or an operation status switching function, thus realizing a radiation characteristics reconfigurable effect resulting into at least two states;

the first and second slot resonators each comprise a series connection structure in which a feeding portion partly intersecting the signal conductor is connected in series to a selective radiation portion not intersecting the signal conductor;

in the at least one of the first and second slot resonators having the at least one function, a high-frequency switching element inserted between the feeding portion and the selective radiation portion provides control as to whether or not to connect between regions of the ground conductor surface which are on both sides astride the slot resonator;

in the at least one of the first and second slot resonators having the RF structure reconfigurability function, a plurality of said selective radiation portions are connected to the feeding portion each in series connection, and the high-frequency switching elements are controlled so that only one selective radiation portion among the plurality of selective radiation portions is connected to the feeding portion in an operating state; and in the at least one of the first and second slot resonators having the operation status switching function, the high-frequency switching element is controlled so that connection between the feeding portion and the selective radiation portion is terminated in a non-operating state.

2. The differentially-fed slot antenna of claim 1, wherein the first slot resonator and the second slot resonator are each fed at a point whose distance from an open end of the differential feed line toward the feed circuit corresponds to a ¼ effective wavelength at the operating frequency.

3. The differentially-fed slot antenna of claim 1, wherein an end point of the differential feed line is grounded via resistors of a same resistance value.

4. The differentially-fed slot antenna of claim 1, wherein an end point of the first signal conductor and an end point of the second signal conductor are electrically connected to each other via a resistor.

5. The differentially-fed slot antenna of claim 1, wherein, one of the at least two states resulting from the radiation characteristics reconfigurable effect is a radiation directivity such that a main beam is directed in a direction having a component in a direction parallel to the differential feed line, the radiation directivity being realized by:

designating two pairs of slot resonators, in each of which a first central portion of a first selective radiation portion of the first slot resonator and a second central portion of a second selective radiation portion of the second slot resonator are disposed at a distance of less than a ¼ effective wavelength at the operating frequency from each other;

disposing the first central portion in the first pair of slot resonators and the first central portion in the second pair of slot resonators so as to be apart by about ½ effective wavelength at the operating frequency; and disposing the second central portion in the first pair of slot resonators and the second central portion in the second pair of slot resonators so as to be apart by about ½ effective wavelength at the operating frequency.

6. The differentially-fed slot antenna of claim 5, wherein the first direction has a component which is orthogonal to a feeding direction of the differential feed line.

7. The differentially-fed slot antenna of claim 1, wherein, one of the at least two states resulting from the radiation characteristics reconfigurable effect is a radiation directivity realized by disposing a first central portion of a first selective radiation portion of the first slot resonator and a second central portion of a second selective radiation portion of the second slot resonator so as to be apart by about ½ effective wavelength at the operating frequency, the radiation directivity being such that a main beam is directed in a first direction connecting between the first central portion and the second central portion, and that a radiation gain in a direction of a plane which is orthogonal to the first direction is suppressed.

8. The differentially-fed slot antenna of claim 1, wherein, one of the at least two states resulting from the radiation characteristics reconfigurable effect is a radiation directivity realized by disposing a first central portion of a first selective radiation portion of the first slot resonator and a second central portion of a second selective radiation portion of the second slot resonator so as to be at a distance of less than a ¼ effective wavelength at the operating frequency from each other, the radiation directivity being such that a main beam is directed in a direction which is orthogonal to the dielectric substrate, and that a directivity gain with respect to a second direction connecting between the first central portion and the second central portion is suppressed.

* * * * *